United States Patent [19]

Berwick et al.

[11] 4,175,960

[45] Nov. 27, 1979

[54] MULTI-ACTIVE PHOTOCONDUCTIVE ELEMENT HAVING AN AGGREGATE CHARGE GENERATING LAYER

[75] Inventors: Martin A. Berwick, Kendall; Charles J. Fox; William A. Light, both of Rochester, all of N.Y.

[73] Assignee: Eastman Kodak Company, Rochester, N.Y.

[21] Appl. No.: 639,039

[22] Filed: Dec. 9, 1975

Related U.S. Application Data

[63] Continuation-in-part of Ser. No. 534,979, Dec. 20, 1974, abandoned.

[51] Int. Cl.[2] ..... G03G 5/06; G03G 3/14

[52] U.S. Cl. ..... 430/58; 430/74; 430/76; 430/64

[58] Field of Search ..... 96/1.5, 1.6, 1.7, 1.8, 96/1 R

[56] References Cited

U.S. PATENT DOCUMENTS

| | | | |
|---|---|---|---|
| 3,615,414 | 10/1971 | Light | 96/1.6 |
| 3,694,462 | 9/1972 | Grisdale | 96/1.6 |
| 3,732,180 | 5/1973 | Gramza | 96/1.6 |
| 3,791,826 | 2/1974 | Cherry et al. | 96/1.8 |
| 3,839,034 | 10/1974 | Weidemann | 96/1.6 |
| 3,871,882 | 3/1975 | Wiedemann | 96/1.6 |
| 3,928,034 | 12/1975 | Regensburger | 96/1.5 |
| 3,973,962 | 8/1976 | Contois et al. | 96/1.7 |

FOREIGN PATENT DOCUMENTS

| | | | |
|---|---|---|---|
| 763540 | 8/1971 | Belgium | 96/1.5 |
| 932197 | 8/1973 | Canada | 96/1.5 |
| 932198 | 8/1973 | Canada | 96/1.5 |
| 1370197 | 10/1974 | United Kingdom | 96/1.5 |

*Primary Examiner*—Roland E. Martin, Jr.
*Assistant Examiner*—John L. Goodrow
*Attorney, Agent, or Firm*—Ronald P. Hilst

[57] ABSTRACT

A multi-active photoconductive insulating element having at least two layers comprising a charge-generation layer and an organic photoconductor-containing charge-transport layer is disclosed. The charge-generation layer contains a continuous polymeric phase having dispersed therein a co-crystalline complex composed of (i) at least one polymer having an alkylidene diarylene group in a recurring unit and (ii) at least one pyrylium-type dye salt.

47 Claims, 22 Drawing Figures

VOLTAGE (-VOLTS)

REST-RUN FATIGUE
400
300
200
100
1st CYCLE COMPOSITE
1st CYCLE CONTROL
500th CYCLE COMPOSITE
500 th CYCLE CONTROL
EXPOSURE - LOGARITHMIC EXPOSURE UNITS

VOLTS (-VOLTS)

LONG RUN FATIGUE
400
300
200
100
CONTROL AFTER 9000 CYCLES
CONTROL AFTER 2000 CYCLES
COMPOSITE AFTER 2000 CYCLES
COMPOSITE AFTER 9000 CYCLES
EXPOSURE - LOGARITHMIC EXPOSURE UNITS

ELECTRICAL DISCHARGE KINETICS

MULTI-ACTIVE PHOTOCONDUCTIVE ELEMENT HAVING AN AGGREGATE CHARGE GENERATING LAYER

This application is a continuation-in-part of Berwick et. al., U.S. Ser. No. 534,979, filed Dec. 20, 1974 now abandoned.

Cross-reference is made to Mey, U.S. Ser. No. 641,058, filed Dec. 15, 1975 now U.S. Pat. No. 4,108,657, a continuation-in-part of Mey, U.S. Ser. No. 534,978, filed Dec. 20, 1974, now abandoned and entitled "Multi-Active Photoconductive Element II."

FIELD OF THE INVENTION

This invention relates to electrophotography and particularly to an improved photoconductive insulating element for use in various electrophotographic processes.

BACKGROUND OF THE INVENTION

Electrophotographic imaging processes and techniques have been extensively described in both the patent and other literature, for example, U.S. Pat. Nos. 2,221,776; 2,277,013; 2,297,691; 2,357,809; 2,551,582; 2,825,814; 2,833,648; 3,220,324; 3,220,831; 3,220,833 and many others. Generally, these processes have in common the steps of employing a photoconductive insulating element which is prepared to respond to imagewise exposure with electromagnetic radiation by forming a latent electrostatic charge image. A variety of subsequent operations, now well-known in the art, can then be employed to produce a permanent record of the charge image.

Various types of photoconductive insulating elements are known for use in electrophotographic imaging processes. In many conventional elements, the active components of the photoconductive insulating composition are contained in a single layer composition. This composition is typically affixed, for example, to a conductive support during the electrophotographic imaging process.

Among the many different kinds of photoconductive compositions which may be employed in typical single active layer photoconductive elements are inorganic photoconductive materials such as vacuum evaporated selenium, particulate zinc oxide dispersed in a polymeric binder, homogeneous organic photoconductive compositions composed of an organic photoconductor solubilized in a polymeric binder, and the like.

Other especially useful photoconductive insulating compositions which may be employed in a single active layer photoconductive element are the high-speed heterogeneous or aggregate photoconductive compositions described in Light, U.S. Pat. No. 3,615,414 issued Oct. 26, 1971 and Gramza et. al., U.S. Pat. No. 3,732,180 issued May 8, 1973. These aggregate-containing photoconductive compositions have a continuous electrically insulating polymer phase containing a finely-divided, particulate, co-crystalline complex of (i) at least one pyrylium-type dye salt and (ii) at least one polymer having an alkylidene diarylene group in a recurring unit.

In addition to the various single active layer photoconductive insulating elements such as those described above, various "multi-active-layer" photoconductive insulating elements, i.e., those having more than one active layer have been described in the art. One useful type of "multi-active-layer" photoconductive element is described in Hoesterey, U.S. Pat. No. 3,165,405 issued Jan. 12, 1965, at column 2, lines 6–20 thereof. As described in this patent, photoconductivity is achieved by applying a uniform positive charge to the surface of an element containing two layers of zinc oxide, a sensitized zinc oxide bottom layer and an unsensitized zinc oxide upper layer, and then exposing the sensitized bottom layer to a pattern of activating radiation. Photoconductivity is produced in the element by the electrical interaction of the two zinc oxide layers. The sensitized zinc oxide bottom layer generates photoelectrons, i.e. negative charge carriers, and injects these charge carriers into the unsensitized zinc oxide upper layer which accepts and transports these charge carriers to the positively charged surface of the photoconductive element.

The concept of using two or more active layers in a photoconductive insulating element, at least one of the layers designed primarily for the photogeneration of charge carriers and at least one other layer designed primarily for the transportation of these generated charge carriers, has been discussed in the patent literature. Such multi-active-layer photoconductive elements are sometimes referred to hereinafter simply as "multi-active" photoconductive elements. In addition to the above-noted Hoesterey patent, a partial listing of representative patents discussing or at least referring to "multi-active" photoconductive elements includes: Bardeen, U.S. Pat. No. 3,041,166 issued June 26, 1962; Makino, U.S. Pat. No. 3,394,001 issued July 23, 1968; Makino et. al. U.S. Pat. No. 3,679,405 issued July 25, 1972; Hayaski et. al., U.S. Pat. No. 3,725,058 issued Apr. 3, 1973; Canadian Pat. No. 930,591 issued July 24, 1973; and Canadian Pat. Nos. 932,197–199 issued Aug. 21, 1973; and British Pat. Nos. 1,337,228 and 1,343,671.

Although there has been a fairly extensive description of specific types of multi-active photoconductive insulating elements in the literature, various shortcomings still exist in these elements so that there is a need to investigate alternative kinds of multi-active elements. For example, the multi-active elements described in the aforementioned Hoesterey patent suffer from the disadvantages of using generally low speed and difficult to clean zinc oxide materials in both active layers of the element. Other multi-active elements such as those described in Canadian Pat. Nos. 930,591 and 932,199 appear to be primarily designed for use in a positive charging mode of operation and therefore may not generally be suitable for use in an electrophotographic process in which a negative charging mode is employed. Furthermore, the type of multi-active elements described in U.S. Pat. Nos. 3,041,166; 3,394,001; 3,725,058 and Canadian Pat. No. 930,591, which employs contiguous organic and inorganic active layers, presents the problem of obtaining good adhesion between two layers of substantially dissimilar materials in a unitary element.

In addition to the above-noted problems and shortcomings associated with prior art multi-active photoconductive elements, it should be noted that, to applicant's knowledge, the art, to date, has generally disclosed no type of multi-active photoconductive element which uses and takes advantage of the above-mentioned high-speed aggregate photoconductive compositions described in Light, U.S. Pat. No. 3,615,414, except as may be described in Seus, U.S. Pat. No. 3,591,374 issued July 6, 1971. The aforementioned Seus patent describes a photoconductive element employing an aggregate photoconductive composition overcoated with a solution of a sensitizing dye of the type useful in preparing the initial aggregate photoconductive composition, ie., a pyrylium-type dye salt, whereby the overcoated dye imbibes into and interacts with the aggregate photoconductive composition to provide an increase in electrophotographic speed of the resultant aggregate composition. In this regard, it is also noted that, Mey, U.S. Ser. No. 534,978, filed Dec. 20, 1974, and cross-referenced hereinabove, described a type of multi-active photoconductive element which includes a layer employing the aggregate photoconductive compositions described in U.S. Pat. No. 3,615,414 together with an inorganic photoconductor-containing layer.

Because of the commercial need for improved aggregate photoconductive compositions, particularly those exhibiting higher electrical speeds as well as improved physical and electrical properties, e.g., lower scum formation, easier cleaning, greater resistance to wear and abrasion, improved panchromatic response, improved resistance to electrical fatigue, and improved resistance to white spot defects under ambient relative humidity conditions, it would be advantageous to develop new types of photoconductive elements which employ and improve on the existing aggregate photoconductive compositions.

SUMMARY OF THE INVENTION

In accord with the present invention there is provided an improved multi-active photoconductive insulating element having at least two layers comprising an organic photoconductor-containing, charge-transport layer in electrical contact with an aggregate, charge-generation layer. A primary feature of the improved multi-active element of the present invention resides in the aggregate, charge-generation layer which contains a continuous, electrically insulating polymer phase and a discontinuous phase comprising a finely-divided, particulate co-crystalline complex of (i) at least one polymer having an alkylidene diarylene group in a recurring unit and (ii) at least one pyrylium-type dye salt.

In accord with a particularly useful embodiment of the invention relating to multi-active photoconductive elements sensitive to visible light, i.e., light in the region of from about 400 to 700 nm, the aggregate charge-generation layer is characterized by having its principal absorption band of radiation in the visible region of the spectrum within the range of from about 520 nm to about 700 nm.

The organic charge-transport layer used in the multi-active elements of the invention contains no particulate, co-crystalline complex and no pyrylium-type dye salt. The charge-transport layer is essentially an organic composition. It is in electrical contact with the charge-generation layer and contains at least one organic photoconductor as the charge-transport material which is capable of accepting and transporting injected charge carriers from the charge-generation layer.

In accord with those particularly useful embodiments of the invention wherein the multi-active element is sensitive to visible light, it is advantageous to select the organic photoconductor(s) contained in the charge-transport layer from organic photoconductive materials whose principal absorption band occurs in a region of the spectrum below about 475 nm., preferably below about 400 nm. In accord with this embodiment, the charge-transport layer is insensitive or, at most, only partially sensitive to visible light. In this embodiment of the invention, the charge-transport layer is substantially transparent (i.e., transmits and does not absorb), as well as substantially insensitive, to visible light so that exposure of the charge-generation layer may be made through the charge-transport layer, if necessary or desirable.

In accord with another embodiment of the invention, the charge-transport layer may be colored or opaque so that it transmits only a portion of or no radiation capable of activating the charge-generation layer. In this embodiment of the invention, exposure of the charge-generation layer to activating radiation is advantageously made by exposing the surface of the generation layer which is opposite the charge-transport layer so that activating radiation for the charge-generation layer need not pass through the charge-transport layer before contacting the charge-generation layer.

Another important feature of the invention resides in the finding that extremely high-speed photoconductive elements can be obtained by controlling the thickness of the charge-transport and charge-generation layers. That is, it has been found that an especially useful embodiment of the multi-active photoconductive element of the invention may be provided using a relatively thin charge generation layer contiguous to a charge-transport layer having a dry thickness from about 5 to about 200 times that of the charge-generation layer. In accord with this embodiment, a particularly high-speed multi-active photoconductive element is obtained using an element having a charge-generation layer having a dry thickness less than about 5.0 microns, and preferably within the range of from about 0.5 to about 2.0 microns. However, as illustrated hereinafter, multi-active elements containing charge-transport layers which have a dry thickness less than that of the charge-generation layer may also be used.

As noted above it has been found that the multi-active photoconductive elements of this invention provide improvements in speed which are not obtainable by use of a single-layer element regardless of the thickness of the single-layer element or the concentration of the components therein. Furthermore, it was found that the multi-active photoconductive elements of this invention not only produced improvements in photoresponse, but, quite unexpectedly, also provided improvements in stability against a number of physical and electrical defects, e.g., reduced scum formation, easier cleaning, improved scratch resistance, improved resistance to white spot defects and electrical fatigue under ambient relative humidity conditions.

It should be understood that the multi-active photoconductive element of the invention may be employed as the light-sensitive electrical image-forming member in a variety of electrophotographic processes, including transfer electrophotographic processes, employing a reusable photoconductive element; non-transfer electrophotographic processes wherein a final visible image is formed on a non-reusable photoconductive element; the so-called TESI processes (i.e., Transfer of Electro-Static Images) such as described by R. M. Schaffert in the book entitled *Electrophotography,* at p. 87–96, The Focal Press, New York (1965); etc. For convenience and purposes of illustration, the multi-active photoconductive element of the invention will be described herein with reference to its use in conventional electrophotographic processes in which an electrostatic charge image is formed at or near the surface of the photoconductive element by employing the now well known steps of (a) applying a uniform electrostatic charge to the top surface of the photoconductive insulating element in the absence of activating radiation while the bottom surface of the element is maintained at a suitable reference potential, thereby creating an electric field through the photoconductive element and (b) imagewise exposing the photoconductive element to activating radiation. However, it will be appreciated by those familiar with the art that the multi-active element of the invention may also be advantageously employed in a wide variety of other known electrophotographic processes.

In accord with the various embodiments of the present invention, the above-described multi-active photoconductive element may be employed in electrophotographic processes using either positive or negative charging of the photoconductive element. Typically, when the multi-active photoconductive element is employed in an electrophotographic process, the element is affixed, either permanently or temporarily, on a conductive support. In such case, by appropriate selection of the charge-transport material in the charge-transport layer, the multi-active element is capable of providing useful electrostatic charge images when used in either a positive or negative charge mode, regardless of whether the charge-generation layer or the charge-transport layer is located adjacent the conductive support. However, in accord with certain preferred embodiments of the invention, when the element is to be used in a positive charging mode, it is particularly advantageous to place the charge-transport layer adjacent to the conductive support. And, when it is desired to use the multi-active element in a negative charging mode, it is particularly advantageous to place the charge-generation layer adjacent the conductive support.

In accord with an especially useful embodiment of the invention, wherein the charge-generation layer of the multi-active element is adjacent to a conductive support, the overcoated charge-transport layer comprises a homogeneous composition of an electrically-insulating polymeric binder and solubilized therein one or more p-type organic photoconductors which are transparent to radiation which activates the charge-generation layer.

BRIEF DESCRIPTION OF THE DRAWINGS

In FIG. 1 charge-transport layer 12 is the upper layer of the multi-active photoconductive In FIG. 2 another embodiment of the multi-active element 14 of the present invention is shown wherein the charge-transport layer 12 is in electrical contact with conducting layer 11. Again, an optional subbing layer between conducting layer 11 and charge-transport layer 12 may be present, if desired. In this embodiment of the invention, the charge-generation layer 10 serves as the upper layer of the multi-active photoconductive element.

DESCRIPTION OF THE PREFERRED EMBODIMENTS

Before proceeding with a detailed description of the various materials which may be employed in the multi-active photoconductive insulating element of the invention, a description of the electrical interaction and function of the charge-transport and charge-generation layer used in the multi-active photoconductive element described herein will be helpful to gain a better understanding of the present invention. Accordingly, a description of the electrical operation occurring in the multi-active photoconductive element of the invention when employed in a conventional electrophotographic imaging process is presented with reference to the attached FIGS.

The charge-transport layer used in the present invention, as its name implies, is a composition which, in the presence of an electrical field, accepts the charge carriers injected into it by the charge-generation layer and transports, i.e. conducts, the charge carriers through the body of the charge-transport layer to the surface thereof. The electrical force driving the charge carriers through the transport layer is supplied by an electric field such as a potential difference applied across the multi-active photoconductive element. Such an electrical driving force may be established, for example, in conventional electrophotographic imaging processes in which the multi-active photoconductive element may be employed, by at least temporarily affixing the element to a conductive substrate maintained at a given reference potential and applying a uniform electrostatic charge of opposite polarity to the surface of the multi-active element in the absence of activating radiation.

The term "activating radiation" as used in the present specification is defined as electromagnetic radiation which is capable of generating electron-hole pairs in the charge-generation layer upon exposure thereof. Thus, when the charge-generation layer is exposed to activating radiation, charge carriers, i.e. electron-hole pairs, are photogenerated therein. In accord with those preferred embodiments of the invention wherein the charge-transport layer is wholly or partially transparent to activating radiation, the charge-transport layer is insensitive or at least relatively insensitive to activating radiation (compared to the charge-generation layer) and therefore generates no or relatively few charge carriers (compared to the number of charge carriers produced by the charge-generation layer) upon exposure to activating radiation.

Figure 1:
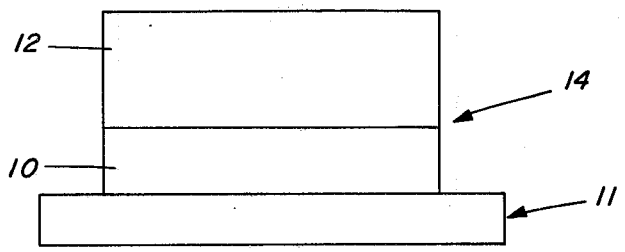
FIG. 1 represents a cross-sectional view of a multi-active photoconductive insulating element 14 of the present invention applied to the surface of a conductive layer 11 wherein charge-generation layer 10 is in electrical contact with conducting layer 11. Although not shown in FIG. 1, one or more optional subbing layer(s) to improve adhesion and/or to modify current flow (e.g. an electrical barrier layer) may be used between conducting layer 11 and charge-generation layer 10.
Figure 2:
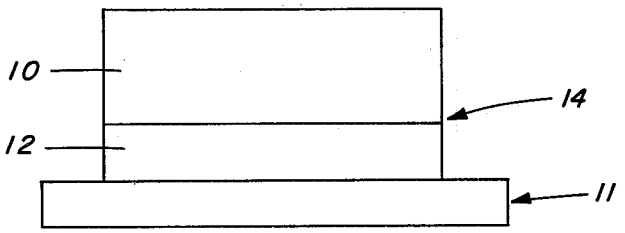

The uniform electrostatic charge applied to the surface of the multi-active element is held at or near the surface due to the electrical insulating properties of the multi-active element in the absence of activating radiation. As illustrated in FIGS. 1 and 2, either the charge-generation layer 10 or the charge-transport layer 12 may be used as the surface layer of the photoconductive element of the invention, and these layers are in electrical contact with one another so that charge carriers generated in the charge-generation layer can flow into the charge-transport layer. The electrical resistivity of the multi-active photoconductive insulating element of the invention (as measured across the charge-transport layer and the charge-generation layer in the absence of activating radiation and any other radiation to which the charge transport layer may be sensitive) should be at least about $10^9$ ohm-cms. at 25° C. In general, it is advantageous to use multi-active elements having a resistivity several orders of magnitude higher than $10^{10}$ ohm-cms., for example, elements having an electrical resistivity greater than about $10^{14}$ ohm-cms. at 25° C.

Having described some of the general functions and characteristics of the charge-transport and charge-generation layer hereinabove, it should be pointed out that there are actually four different modes of operation possible with the element of the present invention using conventional electrophotographic techniques, depending upon the particular composition of the charge-transport layer used in a specific multi-active embodiment. Although, as explained hereinafter, the present invention has been found to provide higher sensitivity and more efficient operation in certain of these modes of operation than in other of these modes, it is possible to use the present invention in each of these four different modes.

Referring now to FIG. 1 wherein charge-generation layer 10 is adjacent conducting layer 11, two modes of operation are possible depending upon whether the element is subjected to an initial uniform negative electrostatic charge or to an initial uniform positive electrostatic charge. These two different modes of operation are presented diagrammatically in FIGS. 3*a*–3*d* and 4*a*–4*d*.

Figure 3A:
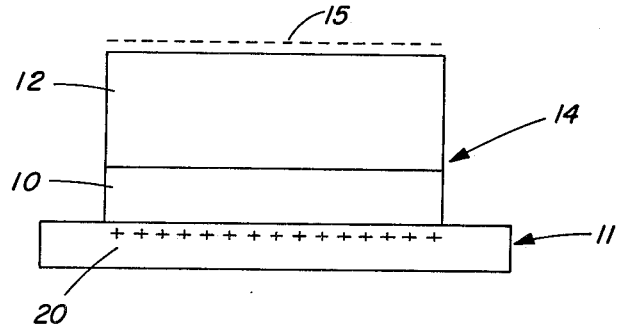
FIGS. 3*a*–3*d*, 4*a*–4*d*, 5*a*–5*d* and 6*a*–6*d* represent diagrammatically the different modes of electrical operation which are believed to occur in the multi-active elements of the invention.
Figure 3B:
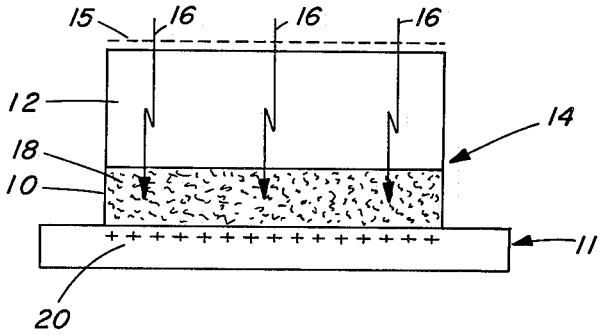

In FIG. 3*a* the multi-active photoconductive element 14, in the absence of activating radiation, is given an initial uniform negative charge 15 with respect to an equipotential reference potential 20 at which conducting layer 11 is maintained. In FIG. 3*b*, element 14 is exposed to activating radiation 16. As a result, as indicated in FIG. 3*b*, the activating radiation passes through the charge-transport layer 12 which is substantially transparent and insensitive to this radiation and contacts the particulate co-crystalline complex 18 located in charge-generation layer 10. Assuming now that activating radiation 16 represents a single photon of light, the electrical process which occurs as radiation 16 strikes a single particle of the co-crystalline complex is illustrated in FIG. 3*c*.

Figure 3C:
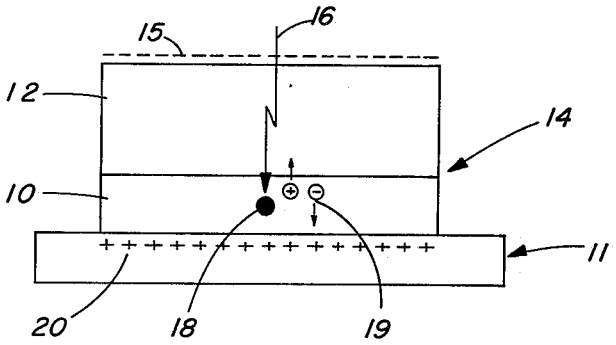

In FIG. 3*c*, upon exposure of particle 18 with radiation 16, charge carriers, i.e. an electron-hole pair 19, are photogenerated by particle 18 which is sensitive to activating radiation 16. Due to the electrical field which is present in multi-active element 14, between conductive layer 11 and the surface of charge-transport layer 12, the photogenerated charge carriers will now begin to migrate through the multi-active photoconductive element. The hole will be electrically attracted to the uniform negative electrostatic charge 15 at the surface of charge-transport layer 12; whereas the electron will migrate toward conducting layer 11 which is maintained at positive reference potential 20 relative to the uniform negative electrostatic charge 15. Once this migration is complete, the original negative uniform charge 15 applied to the surface of layer 12 is effectively neutralized at the point of exposure to activating ray 16. This is caused by the migration of the hole to the surface of charge-transport layer 12 at the point where activating ray 16 passes through charge-transport layer 12.

Figure 3D:
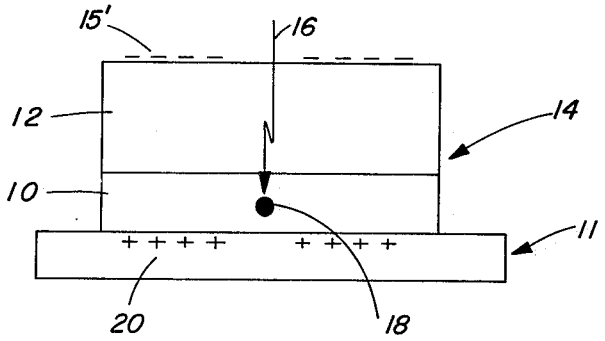

As a result, as shown in FIG. 3*d*, after exposure the multi-active photoconductive element 14 has an electrostatic charge pattern 15' at or near its surface which corresponds to the pattern of activating radiation to which the element was exposed. This charge pattern may then be developed by conventional electrophotographic techniques, or it may be transferred to another dielectric element to be developed at a later time.

Figure 4A:
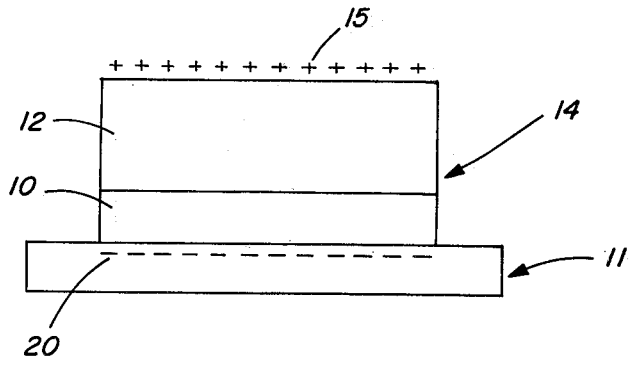
Figure 4B:
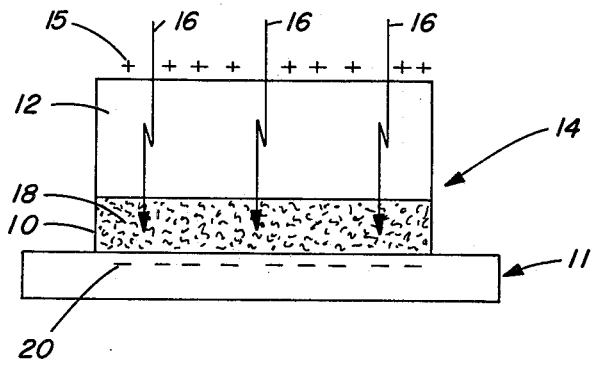
Figure 4C:
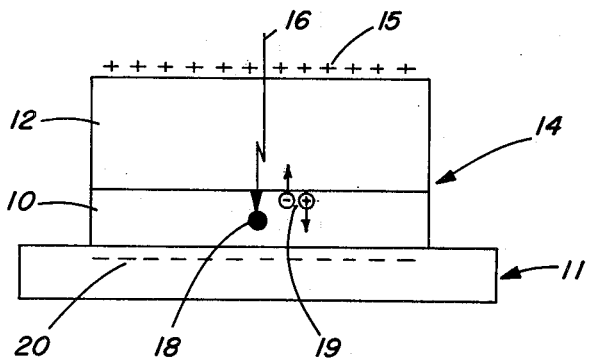
Figure 4D:
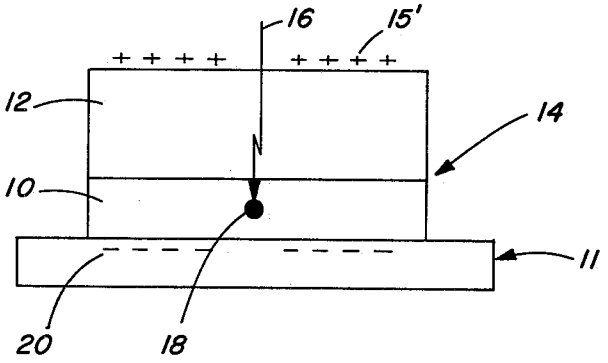

The second mode of operation to which the multi-active photoconductive element 14 in FIG. 1 may be subjected is illustrated diagrammatically in FIGS. 4*a* through 4*d*. This process is quite similar to that illustrated in FIGS. 3*a* through 3*d*, except that the uniform electrostatic charge 15 applied to charge-transport layer 12 has a positive polarity with respect to the reference potential 20 at which conducting layer 11 is maintained. Accordingly, as indicated in FIGS. 4*a*–4*d*, when the exposure of co-crystalline complex particles 18 to activating radiation 16 causes the photogeneration of charge carriers; the hole migrates to conductive layer 11 and the electron migrates to the surface of charge-transport layer 12. As indicated in FIG. 4*d*, the net result of this mode of operation is the formation of a positive electrostatic charge pattern 15' at or near the surface of charge-transport layer 12 which corresponds to the pattern of activating radiation 16 to which multi-active element 14 was exposed.

The two modes of operation associated with the multi-active photoconductive element of FIG. 2 are analogous to that described hereinabove with reference to FIG. 1. In this case, however, as shown in FIG. 2, the position of the charge-transport layer 12 and the charge-generation layer 10 are reversed. Thus, in FIGS. 5*a*–5*d* and 6*a*–6*d* the uniform electrostatic charge which is applied to the surface of multi-active photoconductive element 14 is applied to charge-generation layer 10, rather than to charge-transport layer 12.

Figure 5A:
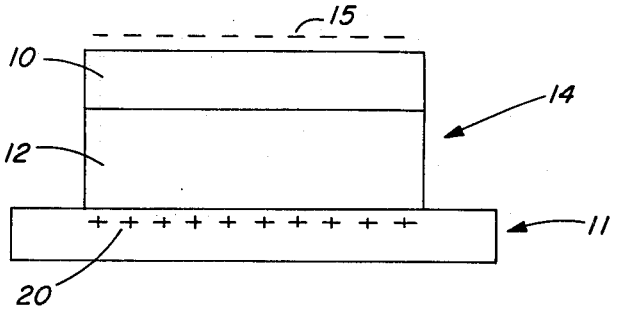
Figure 5B:
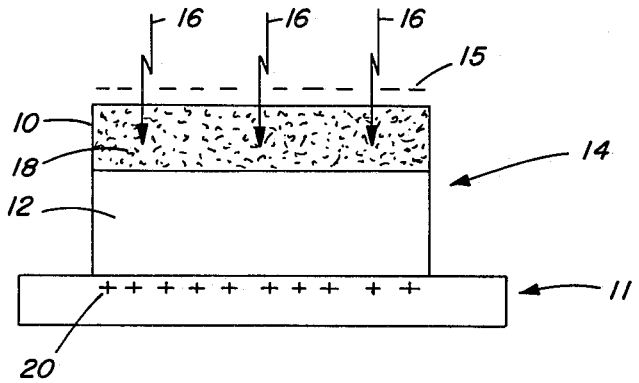
Figure 5C:
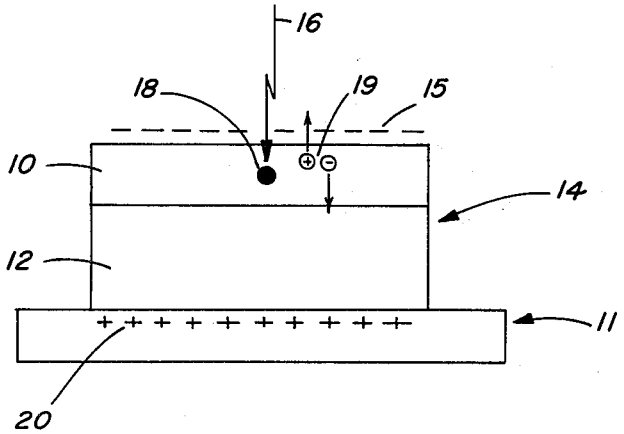
Figure 5D:
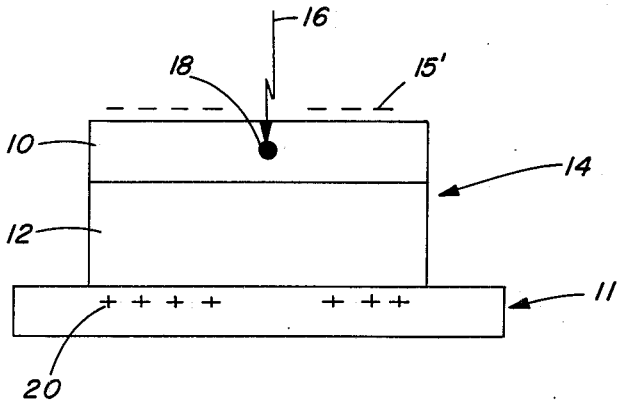

Turning now specifically to FIGS. 5*a*–5*d*, a mode of operation for the element of FIG. 2 is illustrated wherein the charge-generation layer 10 is given a uniform electrostatic charge 15 of negative polarity relative to the reference potential 20 at which conducting layer 11 is maintained. Thus, an electrical field is set up within multi-active element 14 of FIG 5*a*. In FIG. 5*b*, the element bearing the uniform negative polarity electrostatic charge 15 is exposed to activating radiation 16. As a result, as shown in FIG. 5*c*, co-crystalline complex particles 18 are contacted by activating radiation 16 and photogenerate electron-hole pair 19 charge carriers. The hole migrates to the surface of charge-generation layer 10 due to the negative polarity of electrostatic charge residing at this surface, and the electron migrates through charge-transport layer 12 to the interface between conducting layer 11 and charge-transport layer 12. Thus, as shown in FIG. 5*d*, as a result of uniform negative electrostatic charge 15 and the exposure to activating radiation 16, a negative electrostatic charge image pattern 15' is formed at or near the surface of charge-generation layer 10.

Figure 6A:
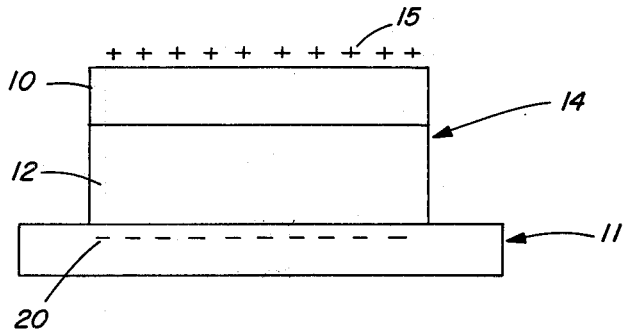
Figure 6B:
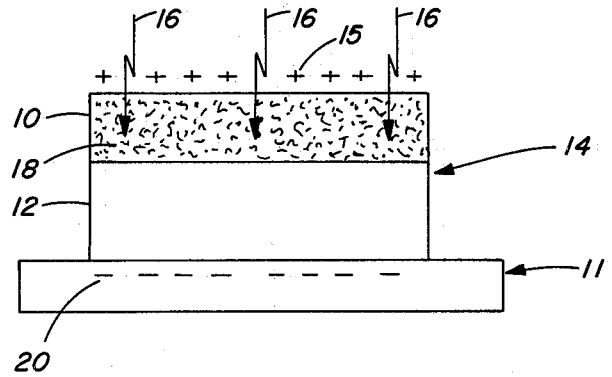
Figure 6C:
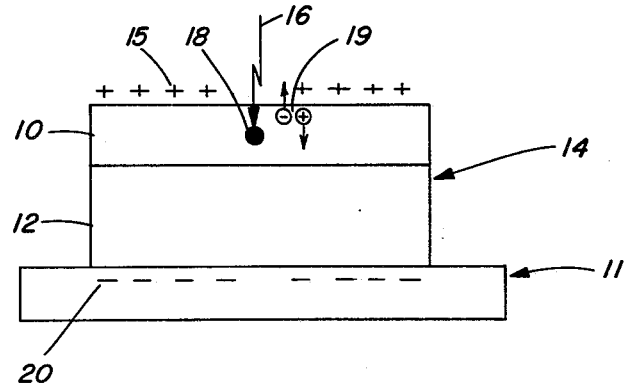
Figure 6D:
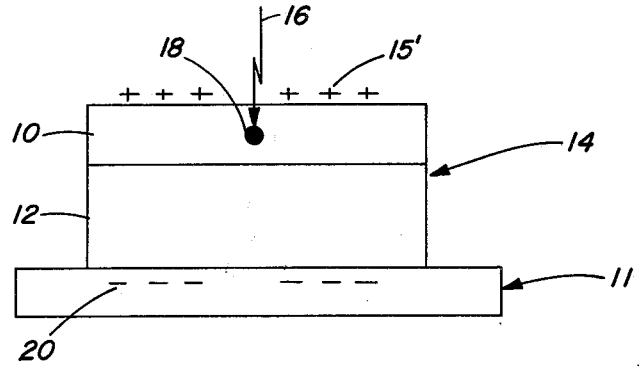

The remaining mode of operation for the multi-active photoconductive element of the present invention having the structural configuration shown in FIG. 2 is illustrated in FIGS. 6a–6d. This electrostatic image-forming process is similar to that described above with respect to FIGS. 5a–5d, except that in FIGS. 6a–6d the uniform electrostatic charge 15 applied to the surface of charge-generation layer 10 has a positive polarity as indicated in FIG. 6a. For this reason, in FIGS. 6b and 6c when activating radiation 16 strikes co-crystalline complex particles 18 to photogenerate electronhole pair 19 charge carriers, the hole and the electron migrate in directions opposite to that depicted in FIG. 5c. Thus, in FIG. 6c the electron migrates to the surface of charge-generation layer 10, and the hole migrates through charge-transport layer 12 to the interface of conducting layer 11 and charge-transport layer 12. As a result, as shown in FIG. 6d, there is formed a positive electrostatic image pattern 15' at or near the surface of charge-generation layer 10 corresponding to the original activating radiation exposure pattern.

Although the present invention has been explained in terms of several differing modes of electrical operation, as outlined briefly hereinbefore, it shall be noted that certain multi-active elements may be employed in more than one mode of operation. For example, certain transport layers are capable of transporting both holes and electrons, so that a multi-active element of the invention using such a transport layer may be capable of all four of the above-described modes of operation.

Figure 7:
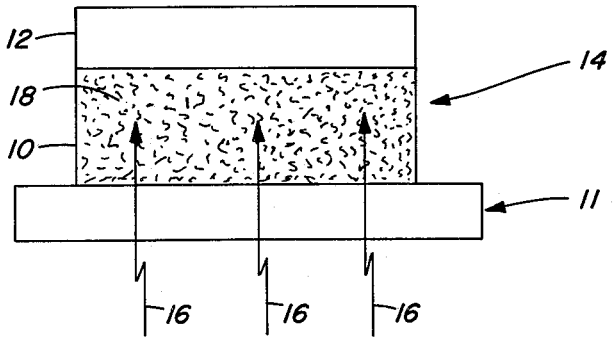
FIG. 7 represents a modification of the various modes of operation represented in FIGS. 3*a*–3*d* and 4*a*–4*d* wherein exposure of the multi-active element of the invention is effected without having the activating radiation for the charge-generation layer pass through the charge-transport layer.

In the four modes of operation illustrated in FIGS. 3a–3d and 4a–4d, exposure of the multi-active element is achieved by exposing the charge generation layer 10 through the charge-transport layer 12. Accordingly, in these particular embodiments of the invention the charge-transport layer must be wholly or at least partially transparent to activating radiation 16. However, in accord with a modification of the present invention illustrated in FIG. 7, it is possible to use a charge-transport layer 12 which is partially or wholly opaque to activating radiation 16 in the modes of operation illustrated in FIG. 3a–3d. This can be done, as illustrated in FIG. 7, by employing as conducting support 11, a conducting support which is transparent to radiation 16 so that radiation 16 can expose charge-generation layer 10 without having to first pass through charge-transport layer 12.

The multi-active elements of the invention, particularly certain preferred embodiments thereof such as that illustrated in FIGS. 3a–3d, offer distinct advantages over conventional single layer aggregate photoconductive compositions as described in Light, U.S. Pat. No. 3,615,414. Among others, it has been found that although conventional single layer aggregate compositions may be made to have varying thicknesses, best results are usually obtained with fairly thin layers having a dry thickness on the order of up to about 15 microns. The relatively high sensitivity of such a single-layer aggregate composition derives mainly from its ability to convert absorbed photons into mobile electron-hole pairs with an efficiency that far exceeds that of other known organic materials, e.g., poly(vinyl carbazole)-2,4,7-trinitro-9-fluorenone photoconductive compositions, and that equals that found in the best inorganic photoconductors, e.g., amorphous selenium, zinc oxide, or cadmium sulfide. However, as aggregate layers thicker than about 15 microns are used, concomitant speed increases are not encountered because the charge carriers appear to have a transport range limitation of about 15 microns. Nevertheless, it would be advantageous to increase the thickness of conventional aggregate photoconductive layers beyond 15 microns so that one could take advantage of the theoretical reduction in the amount of exposure light required to discharge the layer. This theoretical reduction in the amount of required exposure light is the result of the decrease in capacitance and the corresponding reduction in the surface charge density which would occur by increasing the thickness of the photoconductive layer.

The multi-active elements of the present invention as illustrated in FIGS. 3a–3d are readily prepared having thicknesses above 15 microns without encountering any problem associated with charge carrier range limitations. This is because the charge-generation layer which contains the aggregate composition in the multi-active element of the invention can be, and preferably is, a relatively thin layer having a thickness less than 5 microns, whereas the charge-transport layer can be, and preferably is, a relatively thick layer. Using a multi-active element having these structural characteristics in a negative charging mode as shown in FIGS. 3a–3d, one can obtain the advantage of using a relatively thick photoconductive layer while avoiding the range limitations of the charge carriers in conventional single layer aggregate photoconductive elements.

It has also been found that conventional single layer aggregate compositions tend to exhibit a change in their positive charge carrier transport capability as the elements are aged. For example, it is known that conventional aggregate compositions, when subjected to normal room light temperature aging, exhibit a gradual improvement in the transport of positive charge carriers until a constant value is reached after about 100 to 400 hours. In contrast, the multi-active elements of the present inventon, at least in certain embodiments thereof, exhibit improved positive charge carrier transport, both when freshly prepared and when aged, in comparison to conventional single layer aggregate compositions.

In addition, certain embodiments of the invention having the structure shown in FIG. 1 provide a reusable photoconductive element which is significantly easier to clean and much less subject to deterioration and wear than are conventional reusable single layer aggregate photoconductive elements. This advantage is particularly applicable to those embodiments of the invention wherein the charge-transport layer is a homogeneous composition one or more organic photoconductors solubilized in a polymeric binder.

The charge-transport layer used in the multi-active element of the present invention is essentially an organic material-containing composition free from all inorganic photoconductors, i.e., photoconductors such as zinc oxide composed solely of inorganic molecules. The term "organic", as used herein, refers to both organic and metallo-organic materials.

The charge-transport layer used in the present invention contains as the active charge-transport material one or more organic photoconductors capable of accepting and transporting charge carriers generated by the charge-generation layer. The charge-transport layer is free of the above-mentioned cocrystalline complex and any pyrylium-type dye salt. Useful charge-transport materials can generally be divided into two classes depending upon the electronic charge-transport properties of the material. That is, most charge-transport materials generally will preferentially accept and transport either positive charges, i.e. holes, or negative charges, i.e. electrons, generated by the charge-generation layer.

Of course, there are many materials which will accept and transport either positive charges or negative charges; however, even these "amphoteric" materials generally, upon closer investigation, will be found to possess at least a slight preference for the conduction of either positive charge carriers or negative charge carriers.

Those materials which exhibit a preference for the conduction of positive charge carriers are referred to herein as "p-type" charge-transport materials, and those materials which exhibit a preference for the conduction of negative charge carriers are referred to herein as "n-type" charge-transport materials.

The capability of a given organic photoconductor to accept and transport charge carriers generated by the charge-generation layer used in the multi-active elements of the invention can be conveniently determined by coating a layer of the particular organic photoconductor under consideration for use as a charge-transport material (e.g. a 5 to 10 micron thick layer containing about 30 weight percent or more of the organic photoconductive material together with up to about 70 weight percent of a binder, if one is used), on the surface of a charge-generation layer (e.g., a 0.5 to 2 micron aggregate charge-generation layer such as that described more specifically in Example 2 hereinafter) which is, in turn, coated on a conducting substrate. The resultant unitary element may then be subjected to a conventional electrophotographic processing sequence including (a) applying a uniform electrostatic charge to the surface of the layer to be tested for charge-transport properties in the absence of activating radiation while the conducting substrate is maintained at a suitable reference potential thereby creating a potential difference, $V_o$, across the element of, for example, about ±200–600 volts, (b) exposing the charge-generation layer of the resultant element to activating radiation, for example, 680 nm. light energy of 20 ergs/cm.$^2$, and (c) determining the change in the magnitude of the charge initially applied to the element caused by the exposure to activating radiation, i.e., calculating the change in potential difference, $\Delta.V$, across the element as a result of the exposure. If the particular organic photoconductor under consideration as a charge-transport material possesses no charge-transport capability, then the ratio of the quantity $V_o$ to the quantity $V_o-\Delta V$, i.e., the ratio $V_o:(V_o-\Delta V)$, will, to a good approximation, equal the ratio of the sum of the physical thicknesses of the charge-transport layer, $T_{ct}$, and the charge-generation layer, $T_{cg}$, to the physical thickness of the charge-generation layer by itself (i.e. $T_{cg}$), the ratio $(T_{ct}+T_{cg}):T_{cg}$. That is, $V_o:(V_o-\Delta V)\simeq(T_{ct}+T_{cg}):T_{cg}$. If, on the other hand, the particular organic photoconductor under consideration possesses charge-transport capability then the ratio $V_o:(V_o-\Delta V)$ will be greater than the ratio $(T_{ct}+T_{cg}):T_{cg}$, i.e., $V_o:(V_o-\Delta V)>(T_{ct}+T_{cg}):T_{cg}$. If, as is often the case, a binder is employed in the charge-transport layer when the above-described charge-transfer determination is made, care should be taken to account for any charge-transport capability exhibited by the charge-transport layer which may be imparted solely by the binder, rather than by the particular organic photoconductor being evaluated. For example, certain polymeric materials, particularly certain aromatic- or heterocyclic-group-containing polymers have been found to be capable of accepting and transporting at least some of the charge carriers which are injected to it by an adjacent charge-generation layer. For this reason, it is advantageous when evaluating various organic photoconductor materials for charge-transport properties to employ a binder, if one is needed or desired, which exhibits little or no charge transport capability with respect to charge carriers generated by the charge-generation layer of the present invention, for example, a poly(styrene) polymer.

As explained above, among the organic photoconductors which have been found especially preferred as charge-transport materials in the present invention are materials wholly or partially transparent to, and therefore insensitive or substantially insensitive to, the activating radiation used in the present invention. Accordingly, if desired, exposure of the charge-generation layer can be effected by activating radiation which passes through the charge-transport layer before impinging on the generation layer. The organic photoconductors preferred for use as charge-transport materials in the charge transport layer do not, in fact, function as photoconductors in the present invention because such materials are insensitive to activating radiation and, therefore, do not generate electron-hole pairs upon exposure to activating radiation; rather, these materials serve to transport the charge carriers generated by the charge-generation layer. In most cases (except as noted hereinafter with respect to FIG. 7), the charge-transport materials which are prepared for use in a multi-active element of the invention which is sensitive to visible light radiation are organic photoconductors whose principal absorption band lies in a region of the spectrum below about 475 nm. and preferably below about 400 nm. The phrase "organic photoconductors whose principal absorption band is below about 400 nm." refers herein to photoconductors which are both colorless and transparent to visible light, i.e., do not absorb visible light. Those materials which exhibit little or no absorption above 475 nm. but do exhibit some absorption of radiation in the 400 to 475 nm. region will exhibit a yellow coloration but will remain transparent to visible light in the 475 to 700 nm. region of the visible spectrum.

Of course, as noted earlier, where the multi-active element of the invention is exposed to activating radiation as illustrated in FIG. 7, i.e., where the charge-generation layer is exposed without having to expose through the charge-transport layer, it is possible to use organic photoconductive materials in the charge-transport layer which are highy colored or opaque. An example of such a multi-active element is illustrated hereinafter in Example 7 wherein a charge-transport material comprising a mixture of poly(vinyl carbazole) and 2,4,7-trinitro-9-fluorenone is employed. Such a mixture is highly colored having a deep orange coloration and is opaque over a substantial portion of the visible spectrum.

In some cases, where one employs, for example, a charge-generation material having a peak absorption to visible light within the range of from about 520–700 nm., it may be desirable to employ as the charge-transport material a material exhibiting at least some absorption of radiation in the region of the spectrum extending from about 400 nm. to about 520 nm. In such case, one can expose the resultant element to visible light through the transport layer and use the transport layer as (1) a charge-transport material for the charge carriers generated by the charge-generation layer in response to that portion of the visible light in the 520–700 nm. range and (2) a partial charge-generation material for that portion of the visible light below the 520 nm. region with respect to which the charge-generation layer exhibits only minimal sensitivity.

Another useful criteria which has been found helpful in characterizing those charge-transport materials which seem to operate most effectively in the multiactive element of the invention is the finding that, to date, the more useful charge-transport materials are organic photoconductive materials which exhibit a hole or electron drift mobility greater than about $10^{-9}$ cm.$^2$/volt-sec., preferably greater than about $10^{-6}$cm$^2$/volt-sec.

Various p-type organic charge transport materials may be used in the charge transport layers of the present invention. As noted, these materials have the capability of conducting positive charge carriers injected therein. Any of a variety of organic photoconductive materials which are capable of transporting positive charge carriers may be employed. A partial listing of representative p-type organic photoconductive materials encompasses:

1. carbazole materials including carbazole, N-ethyl carbazole, N-isopropyl carbazole, N-phenylcarbazole, halogenated carbazoles, various polymeric carbazole materials such as poly(vinyl carbazole) halogenated poly(vinyl carbazole), and the like.
2. arylamine-containing materials including monoarylamines, diarylamines, triarylamines, as well as polymeric arylamines. A partial listing of specific arylamine organic photoconductors include the particular non-polymeric triphenylamines illustrated in Klupfel et. al., U.S. Pat. No. 3,180,730 issued Apr. 27, 1965; the polymeric triarylamines described in Fox U.S. Pat. No. 3,240,597 issued Mar. 15, 1966; the triarylamines having at least one of the aryl radicals substituted by either a vinyl radical or a vinylene radical having at least one active hydrogen-containing group as described in Brantly et. al., U.S. Pat. No. 3,567,450 issued Mar. 2, 1971; the triarylamines in which at least one of the aryl radicals is substituted by an active hydrogen-containing group as described in Brantly et al. U.S. Pat. No. 3,658,520 issued Apr. 25, 1972; and tritolylamine.
3. polyarylalkane materials of the type described in Noe et al., U.S. Pat. No. 3,274,000 issued Sept. 20, 1966; Wilson; U.S. Pat. No. 3,542,547 issued Nov. 24, 1970; Seus et. al., U.S. Pat. No. 3,542,544 issued Nov. 24, 1970, and in Rule et al., U.S. Pat. No. 3,615,402 issued Oct. 26, 1971. Preferred polyarylalkane photoconductors can be represented by the formula:

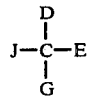

wherein D and G, which may be the same or different, represent aryl groups and J and E, which may be the same or different, represent a hydrogen atom, an alkyl group, or an aryl group, at least one of D, E and G containing an amino substituent. An especially useful polyarylalkane photoconductor which may be employed as the charge transport material is a polyarylalkane having the formula noted above wherein J and E represent a hydrogen atom, an aryl group, or an alkyl group and D and G represent substituted aryl groups having as a substituent thereof a group represented by the formula:

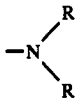

wherein R represents an unsubstituted aryl group such as phenyl or an alkyl substituted aryl such as a tolyl group. Additional information concerning certain of these latter polyarylalkane materials may be found in Rule et al, copending U.S. patent application, Ser. No. 841,270, filed Oct. 12, 1977, a continuation-in-part of Rule et. al. U.S. Ser. No. 639,040, filed Dec. 9, 1975 now abandoned, a continuation-in-part of Rule et. al. U.S. Ser. No. 534,953 filed Dec. 20, 1974 now abandoned.
4. strong Lewis base materials such as various aromatic including aromatically unsaturated heterocyclic-containing materials which are free of strong electron withdrawing groups. A partial listing of such aromatic Lewis base materials includes tetraphenylpyrene, 1-methylpyrene, perylene, chrysene, anthracene, tetraphene, 2-phenyl naphthalene, azapyrene, fluorene, fluorenone, 1-ethylpyrene, acetyl pyrene, 2,3-benzochrysene, 3,4-benzopyrene, 1,4-bromopyrene, and phenyl-indole, polyvinyl carbazole, polyvinyl pyrene, polyvinyl tetracene, polyvinyl perylene, and polyvinyl tetraphene.
5. other useful p-type charge-transport materials which may be employed in the present invention are any of the p-type organic photoconductors, including metallo-organo materials, known to be useful in electrophotographic processes, such as any of the organic photoconductive materials described in *Research Disclosure,* Vol. 109, May 1973, pages 61–67, paragraph IV (A) (2) through (13) which are p-type photoconductors.

Representative of typical n-type charge-transport materials which are believed to be useful are strong Lewis acids such as organic, including metallo-organic, materials containing one or more aromatic, including aromatically unsaturated heterocyclic, materials bearing an electron withdrawing substituent. These materials are considered useful because of their characteristic electron accepting capability. Typical electron withdrawing substituents include cyano and nitro groups; sulfonate groups; halogens such as chlorine, bromine, and iodine; ketone groups; ester groups; acid anhydride groups; and other acid groups such as carboxyl and quinone groups. A partial listing of such representative n-type aromatic Lewis acid materials having electron withdrawing substituents include phthalic anhydride, tetrachlorophthalic anhydride, benzil, mellitic anhydride, S-tricyanobenzene, picryl chloride, 2,4-dinitrochlorobenzene, 2,4-dinitrobromobenzene, 4-nitrobiphenyl, 4,4-dinitrobiphenyl, 2,4,6-trinitroanisole, trichlorotrinitrobenzene, trinitro-O-toluene, 4,6-dichloro-1,3-dinitrobenzene, 4,6,-dibromo-1,3-dinitrobenzene, P-dinitrobenzene, chloranil, bromanil, 2,4,7-trinitro-9-fluorenone, 2,4,5,7-tetranitrofluorenone, trinitroanthracene, dinitroacridene, tetracyanopyrene, dinitroanthraquinone, and mixtures thereof.

As suggested above, other useful n-type charge-transport materials which may be employed in the present invention are conventional n-type organic photoconductors, for example, complexes of 2,4,6-trinitro-9-fluorenone and poly(vinyl carbazole) provide useful n-type charge-transport materials. Still other n-type organic, including metallo-organo, photoconductive materials useful as n-type charge-transport materials in the present invention are any of the organic photoconductive materials known to be useful in electrophotographic processes such as any of the materials described in Research Disclosure, Vol. 109, May 1973, pages 61–67, paragraph IV (A) (2) through (13) which are n-type photoconductors. The foregoing Research Disclosure article is incorporated herein by reference thereto.

As noted earlier herein, in accord with an especially preferred embodiment of the present invention, the organic photoconductive materials useful herein as charge-transport materials are advantageously those materials which exhibit little or no photosensitivity to radiation within the wavelength range to which the charge-generation layer is sensitive, i.e., radiation which causes the charge-generation layer to produce electron-hole pairs. Thus, in accord with a preferred embodiment of the invention wherein the multi-active element of the invention is to be exposed to visible electromagnetic radiation, i.e., radiation within the range of from about 400 to about 700 nm., and wherein the charge-generation layer contains a co-crystalline complex of the type described in greater detail hereinafter which is sensitive to radiation within the range of from about 520 nm. to about 700 nm.; it is advantageous to select as the organic photoconductive material to be used in the charge-transport layer, an organic material which is photosensitive to light outside the 520–700 nm. region of the spectrum, preferably in the spectral region below about 475 nm. and advantageously below about 400 nm. In this regard, the above-described arylamine and polyarylalkane p-type organic photoconductors have been found especially useful as charge-transfer materials.

The charge-transport layer may consist entirely of the charge-transport materials described hereinabove, or, as is more usually the case, the charge-transport layer may contain a mixture of the charge-transport material in a suitable film-forming polymeric binder material. The binder material may, if it is an electrically insulating material, help to provide the charge-transport layer with electrical insulating characteristics, and it also serves as a film-forming material useful in (a) coating the charge-transport layer, (b) adhering the charge-transport layer to an adjacent substrate, and (c) providing a smooth, easy to clean, and wear resistant surface. Of course, in instances where the charge-transport material may be conveniently applied without a separate binder, for example, where the charge-transport material is itself a polymeric material, such as a polymeric arylamine or poly(vinyl carbazole), there may be no need to use a separate polymeric binder. However, even in many of these cases, the use of a polymeric binder may enhance desirable physical properties such as adhesion, resistance to cracking, etc.

Where a polymeric binder material is employed in the charge-transport layer, the optimum ratio of charge-transport material to binder material may vary widely depending on the particular polymeric binder(s) and particular charge-transport material(s) employed. In general, it has been found that, when a binder material is employed, useful results are obtained wherein the amount of active charge-transport material contained within the charge-transport layer varies within the range of from about 5 to about 90 weight percent based on the dry weight of the charge-transport layer.

A partial listing of representative materials which may be employed as binders in the charge-transport layer are film-forming polymeric materials having a fairly high dielectric strength and good electrically insulating properties. Such binders include styrene-butadiene copolymers; polyvinyl toluene-styrene copolymers; styrene-alkyd resins; silicone-alkyd resins; soya-alkyd resins; vinylidene chloride-vinyl chloride copolymers; poly(vinylidene chloride); vinylidene chloride-acrylonitrile copolymers; vinyl acetate-vinyl chloride copolymers; poly(vinyl acetals), such as poly(vinyl butyral); nitrated polystyrene; polymethylstyrene; isobutylene polymers; polyesters, such as poly[ethylene-co-alkylenebis(alkyleneoxyaryl)phenylenedicarboxylate]; phenolformaldehyde resins; ketone resins; polyamides; polycarbonates, polythiocarbonates; poly[ethylene-co-isopropylidene-2,2-bis(ethyleneoxyphenylene)-terephthalate]; copolymers of vinyl haloarylates and vinyl acetate such as poly(vinyl-m-bromobenzoate-co-vinyl acetate); chlorinated poly(olefins), such as chlorinated poly(ethylene); etc. Methods of making resins of this type have been described in the prior art, for example, styrene-alkyd resins can be prepared according to the method described in Gerhart U.S. Pat. No. 2,361,019, issued Oct. 24, 1944 and Rust U.S. Pat. No. 2,258,423, issued Oct. 7, 1941. Suitable resins of the type contemplated for use in the charge transport layers of the invention are sold under such tradenames as VITEL PE-101, CYMAC, Piccopale 100, Saran F-220, and LEXAN 145. Other types of binders which can be used in charge transport layers include such materials as paraffin, mineral waxes, etc, as well as combinations of binder materials.

In general, it has been found that polymers containing aromatic or heterocyclic groups are most effective as the binder materials for use in the charge transport layers because these polymers, by virtue of their heterocyclic or aromatic groups, tend to provide little or no interference with the transport of charge carriers through the layer. Heterocyclic or aromatic-containing polymers which are especially useful in p-type charge-transport layers include styrene-containing polymers, bisphenol-A polycarbonate polymers, phenol-formaldehyde resins, polyesters such as poly[ethylene-co-isopropylidene-2,2-bis(ethyleneoxyphenylene)]terephthalate, and copolymers of vinyl haloarylates and vinylacetate such as poly(vinyl-m-bromobenzoate-co-vinyl acetate).

The charge-transport layer may also contain other addenda such as leveling agents, surfactants, plasticizers, and the like to enhance or improve various physical properties of the charge-transport layer. In addition, various addenda to modify the electrophotographic response of the element may be incorporated in the charge-transport layer. For example, various contrast control materials, such as certain hole-trapping agents and certain easily oxidized dyes may be incorporated in the charge-transport layer. Various such contrast control materials are described in *Research Disclosure,* Volume 122, June, 1974, p. 33, in an article entitled "Additives for Contrast Control in Organic Photoconductor Compositions and Elements".

The thickness of the charge-transport layer may vary. It is especially advantageous to use a charge-transport layer which is thicker than that of the charge-generation layer, with best results generally being obtained when the charge-transport layer is from about 5 to about 200 times, and particularly 10 to 40 times, as thick as the charge-generation layer. A useful thickness for the charge-generation layer is within the range of from about 0.1 to about 15 microns dry thickness, particularly from about 0.5 to about 2 microns. However, as indicated hereinafter, good results can also be obtained using a charge-transport layer which is thinner than the charge-generation layer.

The charge-transport layers described herein are typically applied to the desired substrate by coating a liquid dispersion or solution containing the charge-transport layer components. Typically, the liquid coating vehicle used is an organic vehicle. Typical organic coating vehicles include (1) Aromatic hydrocarbons such as benzene, naphthalene, etc., including substituted aromatic hydrocarbons such as toluene, xylene, mesitylene, etc.;

(2) Ketones such as acetone, 2-butanone, etc.;

(3) Halogenated aliphatic hydrocarbons such as methylene chloride, chloroform, ethylene chloride, etc.;

(4) Ethers including cyclic ethers such as tetrahydrofuran, ethylether;

(5) Mixtures of the above.

The charge-generation layer used in the present invention comprises a layer of the heterogeneous or aggregate composition as described in Light, U.S. Pat. No. 3,615,414 issued Oct. 26, 1971. These aggregate compositions have a multiphase structure comprising (a) a discontinuous phase of at least one particulate co-crystalline compound or complex of a pyrylium-type dye salt and an electrically insulating, film-forming polymeric material containing an alkylidene diarylene group as a recurring unit and (b) a continuous phase comprising an electrically insulating film-forming polymeric material. Optionally, one or more charge-transport material(s) may also be incorporated in this multiphase structure. Of course, these multi-phase compositions may also contain other addenda such as leveling agents, surfactants, plasticizers, contrast control materials and the like to enhance or improve various physical properties or electrophotographic response characteristics of the charge-generation layer.

The aggregate charge-generation composition may be prepared by several techniques, such as, for example, the so-called "dye first" technique described in Gramza et. al., U.S. Pat. No. 3,615,396 issued Oct. 26, 1971. Alternatively, these compositions may be prepared by the so-called "shearing" method described in Gramza, U.S. Pat. No. 3,615,415 issued Oct. 26, 1971. Still another method of preparation involves preforming the finely-divided aggregate particles such as is described in Gramza et. al., U.S. Pat. No. 3,732,180 and simply storing these preformed aggregate particles until it is desired to prepare the charge-generation layer. At this time, the preformed aggregate particles may be dispersed in an appropriate coating vehicle together with the desired film-forming polymeric material and coated on a suitable substrate to form the resultant aggregate charge-generation composition.

In any case, by whatever method prepared, the aggregate composition exhibits a separately identifiable multi-phase structure. The heterogeneous nature of this multi-phase composition is generally apparent when viewed under magnification, although such compositions may appear to be substantially optically clear to the naked eye in the absence of magnification. There can, of course, be microscopic heterogeneity. Suitably, the co-crystalline complex particles present in the continuous phase of the aggregate composition are finely-divided, that is, typically predominantly in the size range of from about 0.01 to about 25 microns.

The terms "co-crystalline complex" or "co-crystalline compound" are used interchangeably herein and have reference to a co-crystalline compound which contains dye and polymer molecules co-crystallized in a single crystalline structure to form a regular array of molecules in a three-dimensional pattern. It is this particulate co-crystalline material dispersed in the continuous polymer phase of the aggregate charge-generation layer which, upon being exposed to activating radiation in the presence of an electric field, generates electron-hole pairs in the multi-active photoconductive elements of the present invention.

Another feature characteristic of conventional heterogeneous or aggregate compositions such as those described in U.S. Pat. Nos. 3,615,414 and 3,732,180 is that the wavelength of the radiation absorption maximum characteristic of such compositions is substantially shifted from the wavelength of the radiation absorption maximum of a substantially homogeneous dye-polymer solid solution formed of similar constituents. The new absorption maximum characteristic of the aggregate composition is not necessarily an overall maximum for the system as this will depend on the relative amount of dye in the aggregate. The shift in absorption maximum which occurs due to the formation of the co-crystalline complex in conventional aggregate compositions is generally of the magnitude of at least about 10 nanometers.

A further advantageous feature of the heterogeneous or aggregate compositions contained in the charge-generation layer of the multi-active element of the invention is that these compositions have been found to be an excellent emitter of both hole and electron charge carriers. Hence, the charge-generation layer used in the invention can be used to inject charge carriers into either n-type or p-type charge transport materials to result in a highly efficient multi-active photoconductive element.

As suggested earlier herein, those charge-generation layers which have been found especially advantageous for use in those embodiments of the invention relating to visible light sensitive multi-active elements are charge-generation layers containing a particulate aggregate material having its principal absorption band of radiation in the visible region of the spectrum within the range of from about 520 nm. to about 700 nm.

The pyrylium type dye salts useful in preparing the co-crystalline complex contained in the charge-generation layer of the present invention includes pyrylium, bispyrylium, thiapyrylium, and selenapyrylium dye salts; and also salts of pyrylium compounds containing condensed ring systems such as salts of benzopyrylium and napthopyrylium dyes are useful in forming such compositions. Typical pyrylium-type dye salts from these classes which are useful in forming these co-crystalline complexes are disclosed in Light, U.S. Pat. No. 3,615,414 noted above.

Particularly useful pyrylium-type dye salts which may be employed in forming the co-crystalline complex are salts having the formula:

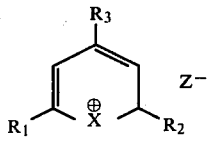

wherein:

$R_1$ and $R_2$ can each be phenyl groups, including substituted phenyl groups having at least one substituent chosen from alkyl groups of from 1 to about 6 carbon atoms and alkoxy groups having from 1 to about 6 carbon atoms;

$R_3$ can be an alkylamino-substituted phenyl group having from 1 to 6 carbon atoms in the alkyl group, and including dialkylamino-substituted and haloalkylamino-substituted phenyl groups;

X can be an oxygen, selenium, or a sulfur atom; and $Z^-$ is an anionic function, including such anions as perchloride, fluoroborate, iodide, chloride, bromide, sulfate, periodate, p-toluenesulfonate, hexafluorophosphate, and the like.

The film-forming polymer used in forming the co-crystalline complex contained in the charge-generation layer used in the present invention may include any of a variety of film-forming polymeric materials which are electrically insulating and have an alkylidene diarylene group in a recurring unit such as those linear polymers, including copolymers, containing the following group in a recurring unit:

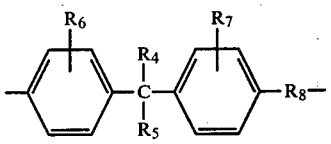

wherein:

$R_4$ and $R_5$, when taken separately, can each be a hydrogen atom, an alkyl group having from one to about 10 carbon atoms such as methyl, ethyl, isobutyl, hexyl, heptyl, octyl, nonyl, decyl, and the like including substituted alkyl groups such as trifluoromethyl, etc., and an aryl group such as phenyl and naphthyl, including substituted aryl groups having such substituents as a halogen atom, an alkyl group of from 1 to about 5 carbon atoms, etc.; and $R_4$ and $R_5$, when taken together, can represent the carbon atoms necessary to complete a saturated cyclic hydrocarbon group including cycloalkanes such as cyclohexyl and polycycloalkanes such as norbornyl, the total number of carbon atoms in $R_4$ and $R_5$ being up to about 19;

$R_6$ and $R_7$ can each be hydrogen, an alkyl group of from 1 to about 5 carbon atoms, e.g., or a halogen such as chloro, bromo, iodo, etc.; and $R_8$ is a divalent group selected from the following:

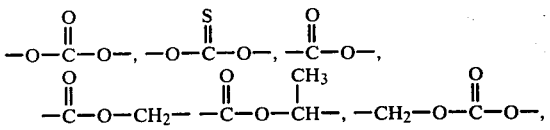

-continued

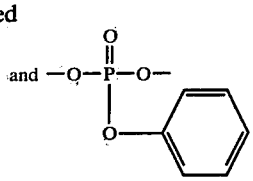

Polymers especially useful in forming the aggregate crystals are hydrophobic carbonate polymers containing the following group in a recurring unit:

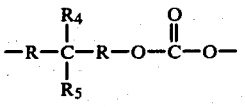

wherein:

Each R is a phenylene group including halo substituted phenylene groups and alkyl substituted phenylene groups; and $R_4$ and $R_5$ are as described above. Such compositions are disclosed, for example, in U.S. Pat. Nos. 3,028,365 and 3,317,466. Preferably polycarbonates containing an alkylidene diarylene moiety in the recurring unit such as those prepared with Bisphenol A and including polymeric products of ester exchange between diphenylcarbonate and 2,2-bis-(4-hydroxyphenyl)propane are useful in the practice of this invention. Such compositions are disclosed in the following U.S. Pat. Nos. 2,999,750 by Miller et. al., issued Sept. 12, 1961; 3,038,874 by Laakso et. al., issued June 12, 1962; 3,038,879 by Laakso et. al., issued June 12, 1962; 3,038,880 by Laakso et. al., issued June 12, 1962; 3,106,544 by Laakso et. al., issued Oct. 8, 1963; 3,106,545 by Laakso et. al., issued Oct. 8, 1963, and 3,106,546 by Laakso et. al., issued Oct. 8, 1963. A wide range of film-forming polycarbonate resins are useful, with completely satisfactory results being obtained when using commercial polymeric materials which are characterized by an inherent viscosity of about 0.5 to about 1.8.

The following polymers of Table A are included among the materials useful in the practice of this invention:

TABLE A

| Number | Polymeric material |
|---|---|
| 1 | Poly(4,4'-isopropylidenediphenylene-co-1-4-cyclohexylenedimethylene carbonate). |
| 2 | Poly(ethylenedioxy-3,3'-phenylene thiocarbonate). |
| 3 | Poly(4,4'-isopropylidenediphenylene carbonate-co-terephthalate). |
| 4 | Poly(4,4'-isopropylidenediphenylene carbonate). |
| 5 | Poly(4,4'-isopropylidenediphenylene thiocarbonate). |
| 6 | Poly(4,4'-sec-butylidenediphenylene carbonate). |
| 7 | Poly(4,4'-isopropylidenediphenylene carbonate-block-oxyethylene). |
| 8 | Poly(4,4'-isopropylidenediphenylene carbonate-block-oxytetramethylene). |
| 9 | Poly[4,4'-isopropylidenebis(2-methylphenylene)-carbonate]. |
| 10 | Poly(4,4'-isopropylidenediphenylene-co-1,4-phenylene carbonate). |
| 11 | Poly(4,4'-isopropylidenediphenylene-co-1,3-phenylene carbonate). |
| 12 | Poly(4,4'-isopropylidenediphenylene-co-4,4'-diphenylene carbonate). |

TABLE A-continued

| | Polymeric material |
|---|---|
| 13 | Poly(4,4'-isopropylidenediphenylene-co-4,4'-oxydiphenylene carbonate). |
| 14 | Poly(4,4'-isopropylidenediphenylene-co-4,4'-carbonyldiphenylene carbonate). |
| 15 | Poly(4,4'-isopropylidenediphenylene-co-4,4'-ethylenediphenylene carbonate). |
| 16 | Poly[4,4'-methylenebis(2-methylphenylene)carbonate]. |
| 17 | Poly[1,1-(p-bromophenylethylidene)bis(1,4-phenylene)carbonate]. |
| 18 | Poly[4,4'-isopropylidenediphenylene-co-4,4-sulfonyldiphenylene)carbonate]. |
| 19 | Poly[4,4'-cyclohexylidene(4-diphenylene) carbonate]. |
| 20 | Poly[4,4'-isopropylidenebis(2-chlorophenylene) carbonate]. |
| 21 | Poly(4,4'-hexafluoroisopropylidenediphenylene carbonate). |
| 22 | Poly(4,4'-isopropylidenediphenylene 4,4'-isopropylidenedibenzoate). |
| 23 | Poly(4,4'-isopropylidenedibenzyl 4,4'-isopropylidenedibenzoate). |
| 24 | Poly[4,4'-(1,2-dimethylpropylidene)diphenylene carbonate]. |
| 25 | Poly[4,4'-(1,2,2-trimethylpropylidene)diphenylene carbonate]. |
| 26 | Poly{4,4'-[1-(α-naphthyl)ethylidene]diphenylene carbonate}. |
| 27 | Poly[4,4'-(1,3-dimethylbutylidene)diphenylene carbonate]. |
| 28 | Poly[4,4'-(2-norbornylidene)diphenylene carbonate]. |
| 29 | Poly[4,4'-(hexahydro-4,7-methanoindan-5-ylidene)diphenylene carbonate]. |

The film-forming electrically insulating polymeric material used in forming the continuous phase of the aggregate charge-generation layer of the present invention may be selected from any of the above-described polymers having an alkylidene diarylene group in a recurring unit. In fact, best results are generally obtained when the same polymer is used to form the co-crystalline complex and used as the matrix polymer of the continuous phase of the aggregate composition. This is especially true when the aggregate particles are formed in situ as the aggregate composition is being formed or coated such as described in the so-called "dye-first" or "shearing" methods described above. Of course, where the particulate co-crystalline complex is preformed and then later admixed in the coating dope which is used to coat the aggregate composition, it is unnecessary for the polymer of the continuous phase to be identical to the polymer contained in the co-crystalline complex itself. In such case, other kinds of film-forming, electrically insulating materials which are well-known in the polymeric coating art may be employed. However, here to it is often desirable to use a film-forming electrically insulating polymer which is structurally similar to that of the polymer contained in the co-crystalline complex so that the various constituents of the charge-generation layer are relatively compatible with one another for purposes of, for example, coating. If desired, it may be advantageous to incorporate other kinds of electrically insulating film-forming polymers in the aggregate coating dope, for example, to alter various physical or electrical properties, such as adhesion, of the aggregate charge-generation layer.

The amount of the above-described pyrylium type dye salt used in the aggregate charge-generation layer may vary. Useful results are obtained by employing the described pyrylium-type dye salts in amounts of from about 0.001 to about 50 percent based on the dry weight of the charge-generation layer. When the charge-generation layer also has incorporated therein one or more charge-transport materials, useful results are obtained by using the described dye salts in amounts of from about 0.001 to about 30 percent by weight based on the dry weight of the charge-generation layer, although the amount used can vary widely depending upon such factors as individual dye salt solubility, the polymer contained in the continuous phase, additional charge transport materials, the electrophotographic response desired, the mechanical properties desired, etc. Similarly, the amount of dialkylidene diarylene group-containing polymer used in the charge-generation layer of the multi-active elements of the invention may vary. Typically, the charge-generation layer contains an amount of this polymer within the range of from about 20 to about 98 weight based on the dry weight of the charge-generation layer, although larger or smaller amounts may also be used.

As noted above, it has been found advantageous to incorporate one or more charge-transport materials in the aggregate composition. Especially useful such materials are organic, including metallo-organic, materials which can be solubilized in the continuous phase of the aggregate composition. By employing these materials in the aggregate composition, it has been found that the resultant sensitivity of the multi-active photoconductive element of the present invention can be enhanced. Although the exact reason for this enhancement is not completely understood, it is believed that the charge-transport material solubilized in the continuous phase of the charge-generation layer aids in transporting the charge carriers generated by the particulate co-crystalline complex of the charge-generation layer to the charge-transport layer and thereby prevents recombination of the charge carriers, i.e., the electron-hole pairs, in the charge-generation layer.

If a charge-transport material is incorporated in the charge-generation layer of the multi-active element of the invention as is described above, the particular material selected should be electronically compatible with the charge-transport material used in the charge-transport layer. That is, if an n-type charge-transport material is used in the charge-transport layer, then an n-type charge-transport material should be incorporated in the aggregate charge-generation composition. Similarly, if a p-type charge-transport material is used in the charge-transport layer of the present invention, then a p-type charge-transport material should be incorporated in the aggregate charge-generation layer of the element.

The kinds of charge-transport materials which may be incorporated in the charge-generation layer include any of the charge-transport materials described above for use in the charge-transport layer. As is the case with the charge-transport layer, if a charge-transport material is incorporated in the aggregate charge-generation layer, it is preferred (although not required) that the particular material selected is one which is incapable of generating any substantial number of electron-hole pairs when exposed to activating radiation for the co-crystalline complex of the charge-generation layer. In this regard, however, it has been found advantageous in accord with certain embodiments of the invention to incorporate a charge-transport material in the aggregate charge-generation layer which, although insensitive to activating radiation for the co-crystalline complex, e.g. visible light in the 520–700 nm. region, is sensitive to, or is capable of sensitizing the co-crystalline complex to, visible light in the 400–520 nm. region of the visible spectrum.

When a charge transport material is incorporated in the charge-generation layer, the amount which is used may vary depending on the particular material, its' compatibility, for example, solubility in the continuous polymeric binder of the charge-generation layer, and the like. Good results have been obtained using an amount of charge-transport material in the charge-generation layer within the range of from about 2 to about 50 weight percent based on the dry weight of the charge-generation layer. Larger or smaller amounts may also be used.

The multilayer photoconductive elements of the invention can be affixed, if desired, directly to a conducting substrate. In some cases, it may be desirable to use one or more intermediate subbing layers between the conducting substrate to improve adhesion to the conducting substrate and/or to act as an electrical barrier layer between the multi-active element and the conducting substrate as described in Dessauer, U.S. Pat. No. 2,940,348. Such subbing layers, if used, typically have a dry thickness in the range of about 0.1 to about 5 microns. Typical subbing layer materials which may be used include film-forming polymers such as cellulose nitrate, polyesters, copolymers of poly(vinyl pyrrolidone) and vinylacetate, and various vinylidene chloride-containing polymers including two, three and four component polymers prepared from a polymerizable blend of monomers or prepolymers containing at least 60 percent by weight of vinylidene chloride. A partial list of representative vinylidene chloride-containing polymers includes vinylidene chloride-methyl methacrylate-itaconic acid terpolymers as disclosed in U.S. Pat. No. 3,143,421. Various vinylidene chloride containing hydrosol tetrapolymers which may be used include tetrapolymers of vinylidene chloride, methyl acrylate, acrylonitrile, and acrylic acid as disclosed in U.S. Pat. No. 3,640,708. A partial listing of other useful vinylidene chloride-containing copolymers includes poly(vinylidene chloridemethyl acrylate), poly(vinylidene chloride-methacrylonitrile), poly(vinylidene chloride-acrylonitrile), and poly(vinylidene chloride-acrylonitrile-methyl acrylate). Other useful subbing materials include the so-called tergels which are described in Nadeau et. al. U.S. Pat. No. 3,501,301.

One especially useful subbing layer which may be employed in the multi-active element of the invention is a hydrophobic film-forming polymer or copolymer free from any acid-containing group, such as a carboxyl group, prepared from a blend of monomers or prepolymers, each of said monomers or prepolymers containing one or more polymerizable ethylenically unsaturated groups. A partial listing of such useful materials includes many of the above-mentioned copolymers, and, in addition, the following polymers: copolymers of polyvinylpyrrolidone and vinyl acetate, poly(vinylidene chloride-methyl methacrylate), and the like.

Optional overcoat layers may be used in the present invention, if desired. For example, to improve surface hardness and resistance to abrasion, the surface layer of the multiactive element of the invention may be coated with one or more electrically insulating, organic polymer coatings or electrically insulating, inorganic coatings. A number of such coatings are well known in the art and accordingly extended discussion thereof is unnecessary. Typical useful such overcoats are described, for example, in *Research Disclosure*, "Electrophotographic Elements, Materials, and Processes", Volume 109, page 63, Paragraph V, May, 1973, which is incorporated by reference herein.

The multi-active elements of the invention may be affixed, if desired, to a variety of electrically conducting supports, for example, paper (at a relative humidity above 20 percent); aluminum-paper laminates; metal foils such as aluminum foil, zinc foil, etc.; metal plates, such as aluminum, copper, zinc, brass and galvanized plates; vapor deposited metal layers such as silver, chromium, nickel, aluminum and the like coated on paper or conventional photographic film bases such as cellulose acetate, polystyrene, etc. Such conducting materials as chromium, nickel, etc., can be vacuum deposited on transparent film supports in sufficiently thin layers to allow electrophotographic elements prepared therewith to be exposed from either side of such elements. An especially useful conducting support can be prepared by coating a support material such as poly(ethylene terephthalate) with a conducting layer containing a semiconductor dispersed in a resin. Such conducting layers both with and without electrical barrier layers are described in U.S. Pat. No. 3,245,833 by Trevoy, issued Apr. 12, 1966. Other useful conducting layers include compositions consisting essentially of an intimate mixture of at least one protective inorganic oxide and from about 30 to about 70 percent by weight of at least one conducting metal, e.g., a vacuum-deposited cermet conducting layer as described in Rasch, U.S. Ser. No. 486,284, filed July 8, 1974. Likewise, a suitable conducting coating can be prepared from the sodium salt of a carboxyester lactone of maleic anhydride and a vinyl acetate polymer. Such kinds of conducting layers and methods for their optimum preparation and use are disclosed in U.S. Pat. Nos. 3,007,901 by Minsk, issued Nov. 7, 1961 and 3,262,807 by Sterman et. al., issued July 26, 1966.

The following examples are presented herein merely to illustrate, not to limit, the present invention.

EXAMPLE 1

Element A of the Invention

A multi-active photoconductive element of the invention was made in the following manner: 10 g of Bisphenol A polycarbonate (inherent viscosity 2.70 in 1,2-dichloroethane) and 1 g of 4-(4-dimethylaminophenyl)-2,6-diphenylthiapyrylium perchlorate were dissolved in 405 ml of dichloromethane by stirring the solids into the solvent for 4 hours at room temperature. The resulting solution was sheared in a water jacketed Waring Blender for 30 minutes. The water in the jacket of the blender was maintained at 50° C. during shearing. The sheared dope was coated at a coverage of 1.08 g/m.$^2$ on a conducting substrate using an extrusion hopper. The dried coating was overcoated with toluene at the rate of 21.6 ml/m.$^2$ to convert it to an aggregated photoconductive layer of the type described in Light, U.S. Pat. No. 3,615,414. Next, 6 g of polystyrene and 4 g of tri-p-tolylamine were dissolved in 65 ml of toluene by stirring the solids in the solvent for 4 hours at room temperature. A multi-active element was then prepared by overcoating the above-described aggregated organic photoconductor layer with the aforementioned polystyrene solution at a coverage of 10.8 g/m.$^2$ using an extrusion hopper.

Element B (Prior Art)

For purposes of comparison, a conventional single layer aggregate photoconductive element was made in the following manner: 70 g of Bisphenol A polycarbonate and 1.4 g of 4-(4-dimethylaminophenyl)-2,6-diphenylthiapyrylium perchlorate were dissolved in 474 ml of dichloromethane by stirring the solids in the solvent for 4 hours at room temperature. The resulting solution was sheared in a water jacketed Waring Blender for 30 minutes. The water in the jacket of the blender was maintained at 15° C. during shearing. After shearing, 1.39 g of tri-p-tolylamine and 12.5 g of a dye solution (solution prepared by dissolving 0.6 g of 4-(4-dimethylaminophenyl)-2,6-diphenylthiapyrylium perchlorate in 203 ml of dichloromethane) were added to 36.1 g of the sheared solution. The resulting mixture was stirred for 1 hour at room temperature using a magnetic stirrer. The resultant solution was coated at 0.015 cm. wet thickness on a conducting substrate.

COMPARISON OF ELEMENT A AND ELEMENT B

Cross-sectional photomicrographs of Elements A and B above were taken. The pictures indicated that Element A consisted of an aggregate layer less than 1μ thick overcoated with a polystyrene/tri-p-tolylamine layer of 10μ in thickness. Single layer Element B was 10μ in thickness. The spectrophotometric transmission characteristics of Elements A and B were also measured. Element A absorbed 90% of the incident radiation at 680 nm; Element B absorbed 92% of the incident radiation at 680 nm. The electrophotograpic speeds measured for Elements A and B at 680 nm. indicated that Element A was about 2–3 times faster than Element B.

EXAMPLE 2

Coating formulations for a multi-active element of the invention were prepared as follows:

| Charge-Transport Layer | |
|---|---|
| Bisphenol A polycarbonate | 60.0 g |
| Tri-tolylamine | 40.0 g |
| Chloroform | 566.7 g |

| Charge-Generation Layer | |
|---|---|
| Bisphenol A polycarbonate | 30.96 g |
| 4-(4-dimethylaminophenyl)-2,6-diphenylthiapyrylium perchlorate | 5.45 g |
| Methylene chloride | 1940.00 g |

The charge-transport layer using the indicated solvent and binder modifications of this example was prepared in a manner similar to the transport layer described in Example 1 except that the polycarbonate and chloroform were stirred together for 12 hours prior to the addition of the tritolylamine. The final transport layer dope was then stirred an additional two hours and coated from an extrusion hopper at 20.5 g solids/m$^2$, after passage through a 5μ in-line filter, at the rate of 5 cm./sec., onto a charge-generation layer (prepared as described below). The charge-generation layer was prepared by first dissolving the thiapyrylium salt in methylene chloride and stirring for 12 hours before adding the Bisphenol A polycarbonate. The dope was then filtered through a Honeycomb Fulflow E17R1-4C2 filter and coated from an extrusion hopper at 1.08 g/m.$^2$ on a 0.4 optical density vacuum-deposited nickeled film support which had been subbed with a vinylidene chloride (83 weight %) methyl acrylate 15 weight %) itaconic acid (2 weight %) terpolymer. Complete aggregation of this layer was obtained by application thereto of a toluene overcoat applied at 43.2 ml/m$^2$. Cross-sectional photomicrographs confirmed a final dry thickness for the multiactive element of this example of 20μ consisting of 1–2μ charge-generation layer as base with an 18–19μ charge-transport layer. The electrophotographic performance of this multi-active element is shown in Table 1 in terms of relative sensitivity measurements using as a control a heterogeneous or aggregate photoconductive element of the type described in Light, U.S. Pat. No. 3,615,414 referred to earlier herein. The control photoconductive element of Table 1 was composed of a 10 micron thick (dry thickness) aggregate photoconductive layer coated on a conductive film support. The aggregate photoconductive layer of the control element, when coated and dried, had a composition identical to Element B of Example 1.

The relative sensitivity measurements reported in this and the following examples are relative electrical sensitivity measurements. The relative electrical sensitivity measures the speed of a given photoconductive element relative to other elements typically within the same test group of elements. The relative sensitivity values are not absolute sensitivity values. However, relative sensitivity values are related to absolute sensitivity values. The relative electrical sensitivity is a dimensionless number and is obtained simply by arbitrarily assigning a value, Ro, to one particular absolute sensitivity of one particular photoconductive control element. The relative sensitivity Rn, of any other photoconductive element, n, relative to this value, Ro, may then be calculated as follows: $Rn=(A_n)(Ro/Ao)$ wherein An is the absolute electrical sensitivity (in ergs/cm.$^2$) of n, Ro is the sensitivity value arbitrarily assigned to the control element, and Ao is the absolute electrical sensitivity (measured in ergs/cm.$^2$) of the control element.

Table 1

ELECTROPHOTOGRAPHIC RESPONSE OF MULTI-ACTIVE PHOTOCONDUCTIVE ELEMENT

| Element | Relative Sensitivity* |
|---|---|
| Multi-active Example 2 | .22 |
| Control | 1.0* |

*Relative Sensitivity represents the relative energy required to discharge the multi-active photoconductive element from −500 volts to −100 volts residual potential as compared to the control element which is arbitrarily assigned a relative sensitivity value of 1.0. The listed values are for exposures to 680 nm. light energy and are corrected for absorption and reflection of the conducting film support. The exposures were made from the rear of the conducting film support. The exposures were made from the rear of the elements, i.e. through the transparent, conducting film support.

EXAMPLE 3

The multi-active element of this example was similar to that described in Example 2, except that a 1μ thick charge-generation layer was used with a 10μ thick charge-transport layer. Table 2 indicates the relative sensitivity exhibited by both fresh and aged samples of this element, and the residual voltage (i.e., $V_o-\Delta V$) remaining on the surface of the multi-active element after exposure to visible light energy (λ=680 nm.) of 20 ergs/cm.$^2$.

EFFECT OF AGING UPON ELECTROPHOTOGRAPHIC SENSITIVITY OF MULTI-ACTIVE PHOTOCONDUCTIVE ELEMENTS

| Feature | Relative Sensitivity[1] λ=680nm | Residual Voltage[2] ($V_o$ - ΔV) |
|---|---|---|
| Freshly coated | 1.0[1] | 0 volts |
| Aged in dark for 36 hours | .84 | 3 volts |

[1]Relative Sensitivity represents the relative energy required to discharge the multi-active photoconductive element from −500 volts to −100 volts residual potential as compared to the control element whivh is arbitrarily assigned a relative sensitivity value of 1.0. The listed values are for exposures to 680 nm. light energy and are corrected for absorption and reflection of the conducting film support. The exposures were made from the rear of the elements, i.e. through the transparent, conducting film support.

[2]$V_o$ - ΔV is the residualpotential remaining on the surface of the multi-active wlement following exposure to light energy (λ= 680 nm. )of 20 ergs/cm. .$V_o$ represents the initial voltage applied to the element prior to exposure and was equal to −500 volts.

EXAMPLE 4

This example demonstrates the relative sensitivity advantages provided by utilization of thicker multi-active photoconductive elements of the invention and illustrates that negative charge carrier range limitations do not affect the sensitivity of the thicker elements.

A series of multi-active elements, Elements C-I, of Table 3, were prepared having a charge-transport layer and charge-generation layer composition as follows:

| Charge-Transport Layer | |
|---|---|
| Polystyrene | 60.0 g |
| Tri-tolylamine | 40.0 g |
| Toluene | 566.7 g |

| Charge-Generation Layer | |
|---|---|
| 4-(4-dimethylaminophenyl)-2,6-diphenyl thiapyrylium perchlorate | 10.50 g |
| Bisphenol A polycarbonate | 61.92 g |
| Methylene chloride | 3568.00 g |

The charge-generation layer was prepared and coated as in Example 2. The charge-transport layer was prepared and coated similar to Example 2, except using a flow rate at 9.7 g solids/m.$^2$ from the extrusion hopper. The final thickness of the dried multi-active photoconductive elements varied from 10μ to 22μ as shown in Table 3.

Table 3

EFFECT OF CHARGE-TRANSPORT LAYER THICKNESS UPON RELATIVE SENSITIVITY OF MULTI-ACTIVE PHOTOCONDUCTIVE ELEMENT

| Element | Overall Multi-Active Element Thickness (microns) | Relative Sensitivity[1] λ = 680nm | Residual Voltage[2] ($V_o$ - ΔV) |
|---|---|---|---|
| C | 10 | 1.0[1] | 2 volts |
| D | 14 | .83 | 3 volts |
| E | 15 | .74 | 4 volts |
| F | 17 | .71 | 23 volts |
| G | 19 | .67 | 8 volts |
| H | 20 | .60 | 10 volts |
| I | 22 | .57 | 6 volts |

[1]Relative Sensitivity represents the relative energy required to discharge the multi-active photoconductive element from −500 volts to −100 volts residual potential as compared to the control element which is arbitrarily assigned a relative sensitivity value of 1.0. The listed values are for exposures to 680 nm. light energy and are corrected for absorption and reflection of the conducting film support. The exposures were made from the rear of the elements, i.e. through the transparent, conducting film support.

[2]$V_o$ - ΔV is the residual potential remaining on the surface of the multi-active element following exposure to light energy (λ = 680 nm.) of 20 ergs/cm.$^2$. $V_o$ represents the initial voltage applied to the element prior to exposure and was equal to −500 volts.

EXAMPLE 5

A series of multi-active photoconductive elements, Elements Nos. I–VIII, of the present invention were prepared using a variety of different charge-transport layers. Each element had an identical 1–2μ thick aggregated photoconductive layer as the charge-generation layer prepared in a manner similar to that described in Example 2. Each of the different charge-transport layers prepared in this example were about 8μ in dry thickness and consisted of 40 weight percent transport material and 60 weight polymeric binder. Fresh (i.e., unaged) and aged samples of each element were tested. The specific composition of the charge-transport layer and the relative sensitivity measurements of each of the multi-active elements prepared in this example are presented herein in Table 4.

Table 4

EFFECT OF VARIOUS ORGANIC CHARGE-TRANSPORT MATERIALS IN THE CHARGE-TRANSPORT LAYER [a] UPON RELATIVE SENSITIVITY

| Element No. | Composition of Charge-Transport Layer: Charge-Transport Material | Polymer Binder | Relative Sensitivity[b] λ= 680 nm. Unaged[c] | Aged[d] |
|---|---|---|---|---|
| I | 4,4'-bis(diehtylamino)-2,2'-dimethyltriphenyl methane | Polystyrene | 1.0[b] | .57 |
| II | Bis-(4-diethylamino)tetra-methylphenyl)methane | Polystyrene | .82 | .43 |
| III | Tris(4-N,N-diethylamino-2-methylphenyl)methane | Polystyrene | .43 | .24 |
| IV | Tri-p-tolyamine- | Polystyrene | .12 | .10 |
| V | 4,4'-bis(diethylamino-2,2'-dimethyltriphenylmethane | Bisphenol A polycarbonate | 1.02 | .65 |
| VI | Bis-(4-diethylamino)tetra-phenylmethane | Bisphenol A polycarbonate | .96 | .35 |
| VII | Tris(4-N,N-diethylamino-2-methylphenyl)methane | Bisphenol A polycarbonate | .65 | .22 |
| VIII | Tri-p-tolylamine | Bisphenol A | | |

Table 4-continued

EFFECT OF VARIOUS ORGANIC CHARGE-TRANSPORT MATERIALS IN THE CHARGE-TRANSPORT LAYER [a] UPON RELATIVE SENSITIVITY

| Element No. | Composition of Charge-Transport Layer Charge-Transport Material | Polymer Binder | Relative Sensitivity[b] λ= 680 nm. Unaged[c] | Aged[d] |
|---|---|---|---|---|
| | | polycarbonate | .10 | .08 |

[a]The charge transport layers were 8μlayers.
[b]Relative Sensitivity represents the relative energy required to discharge the multi-active photoconductive element from −500 volts to −100 volts residual poltential as compared to the control element which is arbitrarily assiggned a relative sensitivity value of 1.0. The listed values are for exposures to 680 nm. light energy and are corrected for were made from the rear of the elements, i.e. through the transparent, conducting film support.
[c]Obtained after 2-hour dark rest from 60° C. over curve.
[d]Obtained after 3-day dark rest from 60° C. over curve. These values represent stable levels.

EXAMPLE 6

As previously noted, the multi-active photoconductive elements of the invention which contain a p-type transport material in the charge-transport layer work most efficiently when negatively charged, unless the order of the charge-generation layer and charge-transport layer is reversed in which case the element then functions best under positive charging. In this example, a multi-active element of the invention was prepared having a charge-transport layer of about 10 microns thickness and a charge-generation layer of about 1 micron thickness. The composition of each of these layers was identical to that of the transport and generation layers described in Example 1. However, in this example, a positive charging mode was used and the order of the transport layer and generation layer was reversed. That is, the transport layer was coated contiguous to the conducting substrate and the generation layer was the surface layer. The structure and mode of operation used to test this element was identical to that described in FIGS. *6a–6d*. Using this positive charge mode of operation, it was found that the multi-active element of this example required an exposure intensity of 37 ergs/cm$^2$ of λ=600 nm. light to discharge from +500 volts to +100 volts.

EXAMPLE 7

In this example a multi-active element of the invention was prepared containing an n-type charge-transport material in the charge-transport layer. This charge-transport layer was then coated over an aggregate charge-generation layer carried on a transparent conductive support. The resultant multi-active element was found to produce useful electrostatic image patterns when subjected to the mode of electrical operation illustrated diagramatically in FIGS. *4a–4d*, namely use of an initial uniform positive surface potential. However, in this particular example, due to the relative opacity of the charge-transport layer, exposure of the element was made through the transparent conducting support as shown in FIG. 7.

The composition of the charge-transport coating dope used in this example was as follows:

| Charge-Transport Layer Coating Composition | |
|---|---|
| Poly(vinylcarbazole) | 1.4 g |
| 2,4,7-trinitrofluorenone (TNF) | 0.6 g |
| Chloroform | 31.3 g |

The composition of the aggregate charge-generation layer and the transparent conductive support used in this example was the same as that described for the multi-active element of Example 2. The preparation and coating procedure for the above-noted charge-transport coating composition was as follows: The poly(vinylcarbazole) was dissolved in the chloroform over 3 hours under stirring and the TNF then added. After an additional 30-minute stirring, the charge-transport coating composition was applied over the charge-generation layer via a handcoating procedure utilizing a 6 mil, fixed edge knife. After drying for 3 minutes at 37.8° C., the resultant multi-active photoconductive film element was cured for 1 hour at 54° C. and rested in the dark for 48 hours. A sample of this film was then charged to +500 volts and subjected to rear illumination (λ=680 nm). The sample film was discharged from +500 to +100 volts with 1350 ergs/cm$^2$ of activating radiation (λ=680 nm).

EXAMPLE 8

Although most multi-active photoconductive elements of the invention have a relatively thin charge-generation layer and a relatively thick charge-transport layer, the multi-active element of the invention will also function well, albeit with a somewhat reduced sensitivity, using a thick charge-generation layer overcoated with a relatively thin charge-transport layer. The multi-active element of this example comprises a 12μ charge-generation layer and a 1μ charge-transport layer prepared as follows:

| Charge-Transport Layer | |
|---|---|
| Bisphenol-A-polycarbonate (Lexan® 145 purchased from G.E. Co.) | 48.0 g |
| Bis-(4-diethylamino)tetraphenylmethane | 32.0 g |
| Chloroform | 1253.6 g |

| Charge-Generation Layer | |
|---|---|
| Part A | |
| 4-(4-dimethylaminophenyl)-2,6-diphenylthiapyrylium hexafluorophosphate | 14.4 g |
| Dichloromethane | 882.0 g |
| 1,1,2-trichloroethane | 436.0 g |
| Bisphenol-A-polycarbonate (Lexan® 145 purchased from G.E. Co.) | 102.4 g |
| Part B | |
| Dichloromethane | 662.3 g |
| 1,1,2-trichloroethane | 283.9 g |
| Bis-(4-diethylamino)tetraphenylmethane | 96.0 g |

To form the charge-generation layer of this example, the hexafluorophosphate thiapyrylium salt was dissolved in the solvent mix of Part A for 12 hours under magnetic stirring whereupon the Lexan® 145 was added in two portions, 15 minutes apart. The solution was then stirred an additional 3 hours, sheared for 0.5 hours in a Waring type blender and exactly one half of the sheared solution added to Part B—a solution of bis-(4-diethylamino)tetraphenylmethane in 1,1,2-trichloroethane and dichloromethane. The dope was filtered and coated at 12.9 g/m$^2$ similar to Example 2 on a suitable conductive substrate to form a 12$\mu$ dry thickness charge-generation layer.

The charge-transport layer was formulated similar to Example 2 and coated at 1.08 g/m$^2$ over the above-described charge-generation layer to form a 1$\mu$ dry thickness transport layer. The multi-active element of this example exhibited improved relative sensitivity over that obtainable with a comparable single-layer aggregate photoconductive element.

EXAMPLE 9

In this Example a series of tests were conducted to demonstrate certain of the improved properties, including physical, chemical and sensitivity properties, of the multi-active elements of the present invention in comparison to the single-layer "aggregate" photoconductive elements previously employed in the art as described, for example, in Light, U.S. Pat. No. 3,615,414. The single-layer "aggregate" photoconductive element selected as a control in this Example was composed of a polyethylene terephthalate support bearing a conductive layer composed of a 0.4 optical density vacuum-deposited nickel layer and a single-layer aggregate photoconductive composition coated on the surface of the conductive nickel layer. The composition of the single layer aggregate photoconductive element was as follows:

a. Lexan® 145 polycarbonate, 60 parts by weight based on dry weight of single layer aggregate composition
b. 4,4'-bis-(diethylamino)-2,2'-dimethyltriphenylmethane, 40 parts by weight based on dry weight of single layer aggregate composition
c. 4-(4-dimethylaminophenyl)-2,6-diphenyl thiapyrylium fluoroborate, 3 parts by weight based on dry weight of single layer aggregate composition The above-noted formulation (a)-(c) was coated from 10 weight percent solids in a solvent system composed of 60 percent dichloromethane and 40 percent 1,1,2-trichloroethane. The thiapyrylium salt (c) of the formulation was aggregated with the polycarbonate (a) of the above-noted formulation during the coating of the formulation onto the conductive nickel layer of the support. Useful such techniques for obtaining aggregation during the coating operation are described in Example 1 and in Kryman et. al., U.S. Pat. No. 3,679,408 issued July 25, 1972 and Gramza et al., U.S. Pat. No. 3,615,396 issued Oct. 26, 1971. The resultant dry thickness of the above-described single-layer aggregate composition was 10 microns.

This particular single layer aggregate photoconductive composition was selected because of its recognized performance characteristics establishing it as an optimum aggregate photoconductive composition, enabling it to be employed as a reusable photoconductive material in a high-speed, plain-paper office copier-duplicator machine.

The multi-active photoconductive element of the present invention used in this example had a polyethylene terephthalate support and a nickel conductive layer identical to the control single-layer aggregate element. The multi-active element had a 1.25 micron thick (dry thickness) aggregate charge generation coated on top of the nickel conductive layer and a 15 micron thick (dry thickness) charge transport layer coated on top of the aggregate charge generation layer. The method of preparation of the charge generation layer used in this example was similar to that described in Example 6 of U.S. Pat. No. 3,615,415 issued Oct. 26, 1971. That is, a small portion, i.e., about 270 parts by weight, of the organic solvent coating dope (described hereinbelow) used to prepare the aggregate charge generation layer was first subjected to a 2-hour period of shearing action in a Waring Blender, and then this "preblended" portion of dope was added to the remaining aggregate coating dope, the entire dope then being subjected to a brief additional period of shearing prior to coating the dope on the nickel conductive layer of the support. The organic solvent coating dope used to prepare the aggregate charge generation layer had the following composition:

High molecular weight polycarbonate—66.5 parts by weight
4-(4-dimethylaminophenyl)-2,6-diphenylthiapyrylium hexafluorophosphate—32.4 parts by weight
Tritolylamine (organic photoconductive charge transport material)—18.8 parts by weight
Dichloromethane (solvent)—3500.0 parts by weight
1,1,2-trichloroethane (solvent)—1500.0 parts by weight The charge transport layer was coated from an organic solvent coating dope having the following composition:

High molecular weight polycarbonate—8.6 parts by weight
Lexan® 145 polycarbonate (an intermediate molecular weight polycarbonate)—77.8 parts by weight
Tritolylamine (an organic photoconductive charge transport material)—38.2 parts by weight
1,1-bis(4-di-p-tolylaminophenyl)-cyclohexane (an organic photo-conductive charge transport material)—19.4 parts by weight
chloroform (solvent)—1056.0 parts by weight

TEST ONE

Figure 8:
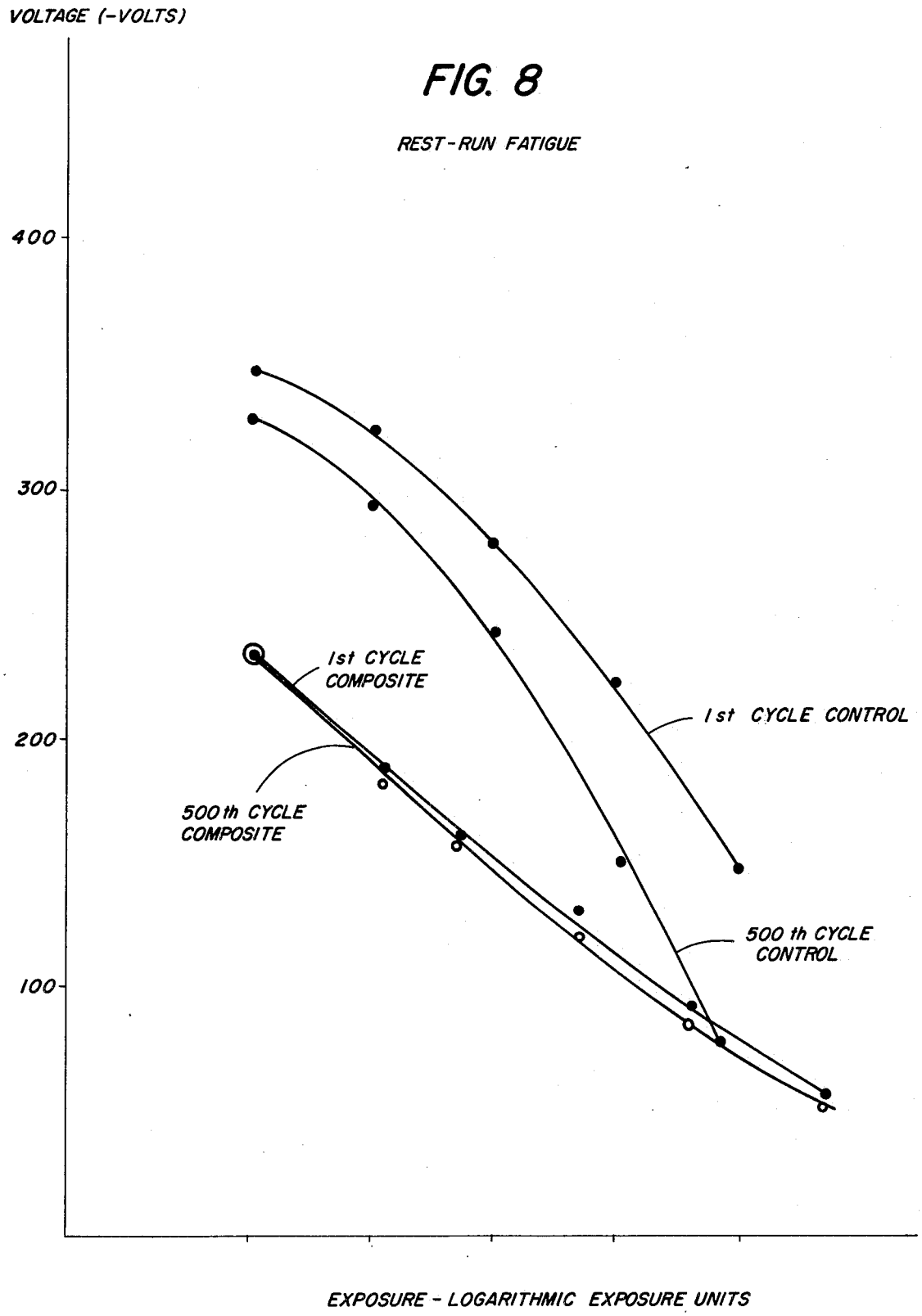
FIGS. 8–10 are graphs illustrating various improved performance characteristics of the multi-active elements of the present invention over single layer aggregate photoconductive elements of the type described in Light, U.S. Pat. No. 3,615,414.

In the first test, the above-described control single-layer aggregate photoconductive element (hereinafter designated Control) and the above-described multi-active element of the present invention (hereinafter designated Composite) were set up for use under equivalent test conditions in a plain paper electrophotographic copy device and evaluated for "rest-run" fatigue properties. In this test, both the Control and the Composite, after being rested in the dark under identical conditions, were subjected to 500 continuous electrical imaging cycles, to find any differences in the electrical photoresponse of the Control and the Composite from the first cycle to the 500th cycle. If such differences do exist, one must somehow construct compensation mechanisms into the electrophotographic copy machine which would employ such a film or tolerate differences in print quality which can occur as a result of such "rest-run" fatigue properties. Ideally, the electrical photoresponse of a given photoconductive film would be the same after the 500th cycle as it is for the first cycle. The results of this test are depicted in FIG. 8. As is apparent, the Control does exhibit a noticeable difference in electrical photoresponse from the first cycle to the 500th electrical imaging cycle. In contrast, the Composite exhibits nearly identical electrical photoresponse from the first to the 500th imaging cycle. FIG. 8 represents a graph of voltage, i.e., the residual voltage present on the surface of the Control and the Composite during the test, plotted in linear units as a function of the intensity of the light exposure used to discharge the films plotted in logarithmic exposure units. The initial charge or voltage level applied to the surface of the Composite and the Control at the beginning of each cycle of this 500 cycle test was identical, approximately −450 volts. The graph of FIG. 8 represents the voltage decay for the Composite and the Control over a major portion of the exposure range. Because the Composite exhibited much greater electrical photosensitivity than the Control, it will also be noted in FIG. 8 that, for a given exposure level, the Composite advantageously shows a much greater voltage drop, i.e., a lower residual voltage level, than the Control.

TEST TWO

Figure 9:
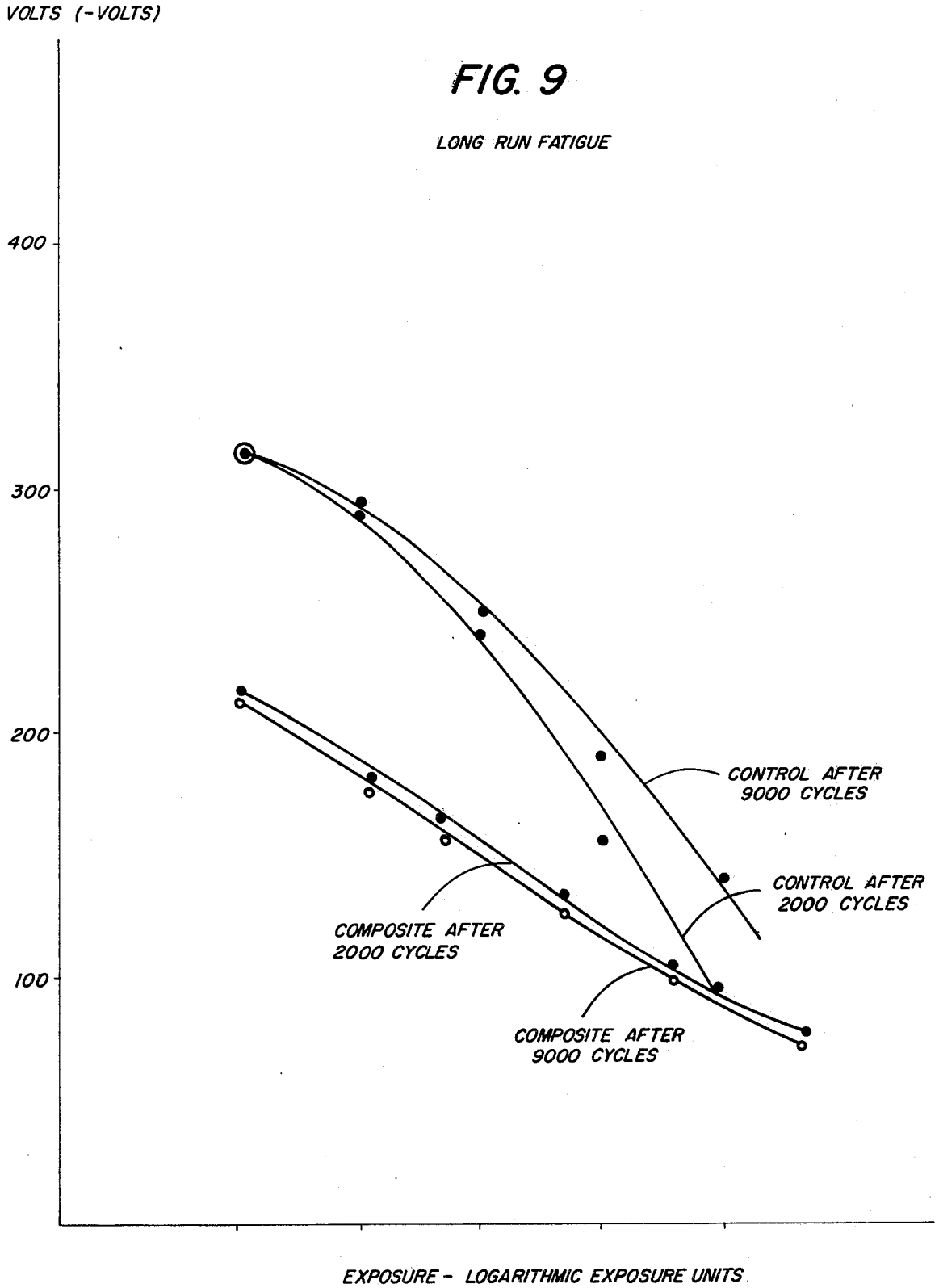

This test is similar to that of Test One, except that the purpose of this test is to measure the "long run" fatigue properties of the Control and the Composite. In this test, both the Control and the Composite were run under identical conditions in a test electrophotographic copy device for 9000 continuous electrical imaging cycles. In this test the electrical photoresponse of the Control and the Composite were evaluated on the 2000th and the 9000th imaging cycle to evaluate the difference in photoresponse of these films after being subjected to a "long run", i.e., 9000 continuous imaging cycles. Again the Composite and Control were subjected to identical electrical imaging cycles during the test so that the initial voltage level to which each film was charged at the start of each cycle was identical. The results of this test are depicted in FIG. 9. As is apparent, the Composite once again shows substantially more stable photoresponse than does the Control.

TEST THREE

Figure 10:
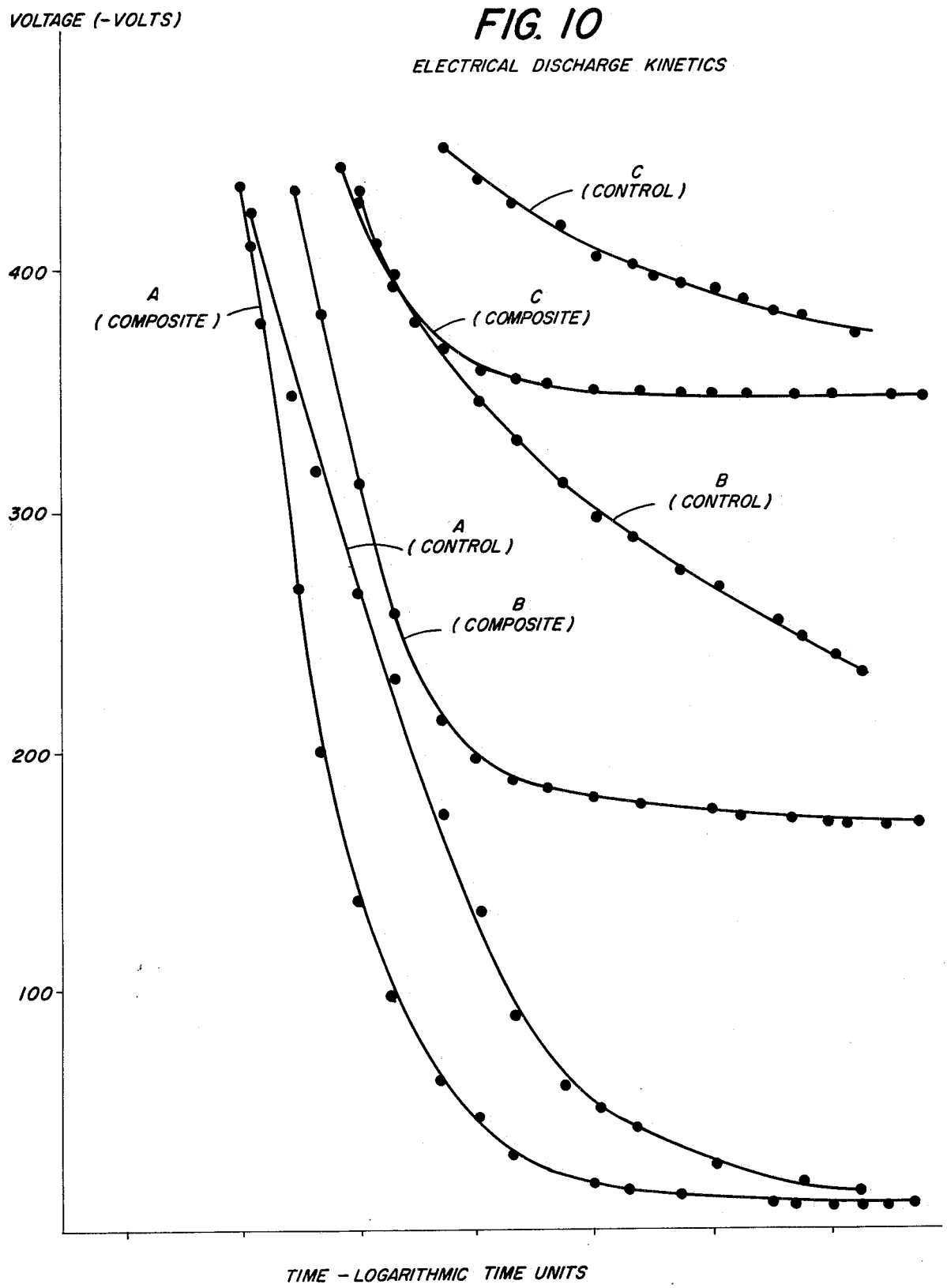

In this test the electrical discharge kinetics of the Composite and the Control were compared to demonstrate, that for a given exposure level, the Composite exhibits a generally improved rate of photoresponse in comparison to the Control. In this test three different intensity exposure levels, labelled A, B, and C are used to demonstrate the photoresponse of the Composite and the Control to high, intermediate, and low intensity exposures, respectively. In this test, the initial charge level used for the Composite and the Control were substantially identical for each level of exposure intensity. In FIG. 10, voltage is plotted in linear units as a function of exposure time measured in logarithmic time units.

TEST FOUR

In this test the improved wear life of the Composite in comparison to the Control was evaluated. In this test a sample of the Composite film and a sample of the Control film were subjected to various identical abrasion tests. Then the abraded film samples were subjected to a conventional electrophotographic imaging cycle consisting of uniform charging, exposure to test pattern, development, transfer of developed image to plain paper copy sheet, and cleaning to determine the effect each abrasion test on the film samples produced on the final plain paper copies produced from the film samples. Unexpectedly, it was found that although both the Control and the Composite exhibited similar physical surface deformations, scuffing, scratches and the like as a result of the various abrasion treatments to which the film samples were subjected, the abraded Composite film produced final plain paper copies that showed little or no trace of the original abrasion treatment of the Composite. In contrast, the Control produced plain paper copies which invariably contained a visible trace of the original abrasion treatment to which the Control had been subjected. Both the Composite and the Control samples were subjected to the following abrasion treatments:

1. surface scuffing by Crocus sandpaper
2. surface scuffing by International Xerographic Bond paper
3. surface scratching using a stylus under low pressure
4. surface scratching using a stylus under high pressure

TEST FIVE

In this test the environmental wear properties of the Composite and the Control were evaluated under high humidity conditions to evaluate the ability of these two films to resist "white spot" formation. White spot is a term used to describe certain physical and electrical defects which tend to appear in organic photoconductive films after the film is subjected to fairly constant operation under high relative humidity conditions. The exact reasons for the formation of these defects under high relative humidity conditions are not fully understood, but it is believed that these defects correspond to areas of the organic photoconductive layer which overlie fine breaks or cracks formed in the conductive layer underlying the photoconductive layer of the film. It is known that organic photoconductive elements in which such defects have been formed produce undesirable, visible print defects in plain paper copies electrophotographically reproduced from such elements. These defects in plain paper copy output generally take the form of a pattern of complete or partial image density loss, i.e., "white spots", corresponding to the pattern of defects present in the organic photoconductive element. As a result of this test, it was found that, after being subjected to identical electrophotographic electrical imaging operation under high relative humidity conditions, i.e., 80–90% R.H. at about 22° C., plain paper copy produced from the Composite exhibited significantly fewer visible white spot defects than plain paper copy produced from the Control. Although the reasons for this substantial difference in imaging are not fully understood, it is noted that the conductive layer (which is known to be a major contributor to "white spot" formation as explained above) was the same in both the Composite and Control films of this test. Thus, the difference in "white spot" formation in final plain paper copy produced from the Composite and Control films tested is directly attributable to the fact that the Composite is, unexpectedly, significantly less susceptible to white spot formation than is the Control.

TEST SIX

In this test, both the Control and the Composite were subjected to approximately 5000 imaging cycles as described in Test Four, and then both the Composite and the Control were examined for developer "scumming". Such "scumming" is the residue of electrographic developer material, primarily toner-particle-like material, which builds up on the film surface as a result of successive development cycles and which cannot easily be removed from the film surface. As a result of this test it was found that the scum level of the Control was about 83 milligrams/square meter of Control film surface. Although this is an acceptable level of scumming, one would, of course, desire to minimize the scum level to as low a value as possible so that there is as little build-up of developer residue on the film surface as possible, thereby minimizing interference with film imaging characteristics and maximizing film wear life. Accordingly, the scum level of the Composite which was measured at the end of this test to be 0.0 mg./m$^2$ of Composite film surface was considered truly outstanding.

The invention has been described in detail with particular reference to certain preferred embodiments thereof, but it will be understood that variations and modifications can be effected within the spirit and scope of the invention.

We claim:

1. A photoconductive insulating element having at least two layers comprising a charge-generation layer in electrical contact with a charge-transport layer, (a) said charge-generation layer comprising a continuous, electrically insulating polymer phase and dispersed in said continuous phase a discontinuous phase comprising a finely-divided, particulate co-crystalline complex of (i) at least one polymer having an alkylidene diarylene group in a recurring unit and (ii) at least one pyrylium-type dye salt, said co-crystalline complex, upon exposure to activating radiation for said complex, capable of generating and injecting charge carriers into said charge-transport layer, the particulate, co-crystalline complex of said discontinuous phase having a size of about 0.01 to about 25 microns, said charge generation layer having a maximum radiation absorption at a wavelength at least about 10 nm. different from the wavelength of maximum absorption of said pyrylium-type dye salt solubilized with said alkylidene diarylene group-containing polymer in a homogeneous composition, (b) said charge-transport layer being an organic composition free from said co-crystalline complex and said pyrylium-type dye salt, and comprising as a charge-transport material an organic photoconductive material capable of accepting and transporting injected charge carriers from said charge-generation layer.

2. A photoconductive insulating element as defined in claim 1 wherein said charge-transport layer comprises a polymeric binder and a p-type organic photoconductive charge-transport material.

3. A photoconductive insulating element as defined in claim 1 wherein said charge-transport layer comprises a polymeric binder and an n-type organic photoconductive charge-transport material.

4. A photoconductive insulating element having at least two layers comprising a charge-generation layer contiguous to a charge-transport layer, (a) said charge-generation layer comprising a charge-transport material in solid solution with a continuous, electrically insulating polymer phase and dispersed in said continuous phase a discontinuous phase comprising a finely-divided, particulate co-crystalline complex of (i) at least one polymer having an alkylidene diarylene group in a recurring unit and (ii) at least one pyrylium-type dye salt, said co-crystalline complex, upon exposure to activating radiation for said complex, capable of generating and injecting charge carriers into said charge-transport layer, the particulate, co-crystalline complex of said discontinuous phase having a size of about 0.01 to about 25 microns, said charge generation layer having a maximum radiation absorption at a wavelength at least about 10 nm. different from the wavelength of maximum absorption of said pyrylium-type dye salt solubilized with said alkylidene diarylene group-containing polymer in a homogeneous composition, (b) said charge-transport layer being an organic composition insensitive to said activating radiation and free from said co-crystalline complex and said pyrylium-type dye salt, said charge-transport layer comprising as a charge-transport material an organic photoconductive material capable of accepting and transporting charge carriers from said charge-generation layer.

5. A photoconductive insulating element as defined in claim 4 wherein said charge-transport material comprises a p-type organic photoconductive charge-transport material.

6. A photoconductive insulating element as defined in claim 4 wherein said charge-transport material contained in said charge-generation layer comprises an n-type organic photoconductive charge-transport material.

7. A photoconductive insulating element having at least two layers comprising a charge-generation layer in electrical contact with a charge-transport layer, (a) said charge-generation layer having a dry thickness less than about 15 microns and comprising a continuous electrically insulating polymer phase and dispersed in said continuous phase a discontinuous phase comprising a finely-divided particulate co-crystalline complex of (i) at least on polymer having an alkylidene diarylene group in a recurring unit and (ii) at least one thiapyrylium dye salt, said co-crystalline complex, upon exposure to radiation within the range of from about 520 to about 700 nm., capable of generating and injecting charge carriers into said charge-transport layer, the particulate, co-crystalline complex of said discontinuous phase having a size of about 0.01 to about 25 microns, said charge generation layer having a maximum radiation absorption at a wavelength at least about 10 nm. different from the wavelength of maximum absorption of said thiapyrylium dye salt solubilized with said alkylidene diarylene group-containing polymer in a homogeneous composition, (b) said charge-transport layer being an organic composition free from said co-crystalline complex and any pyrylium-type dye salt and comprising as a charge-transport material an organic photoconductive material having a principal absorption band below about 475 nm. and capable of accepting and transporting injected charge carriers from said charge-generation layer.

8. A photoconductive insulating element as defined in claim 7 wherein said charge-generation layer comprises an organic photoconductive charge-transport material in solid solution with said continuous phase, said transport material being electronically compatible with the transport material contained in said charge-transport layer.

9. A photoconductive insulating element as defined in claim 7 wherein said charge-transport layer has a dry thickness greater than that of said charge-generation layer.

10. A photoconductive insulating element as defined in claim 7 wherein said charge-transport layer has a dry thickness less than that of said charge-generation layer.

11. A photoconductive insulating element having at least two layers comprising a charge-generation layer in electrical contact with a charge-transport layer, (a) said charge-generation layer having a dry thickness within the range of from about 0.5 to about 15.0 microns and comprising a p-type organic photoconductive charge-transport material in solid solution with a continuous, electrically insulating polymer phase and dispersed in said continuous phase a discontinuous phase comprising a finely-divided, particulate co-crystalline complex of (i) at least one polymer having an alkylidene diarylene group in a recurring unit and (ii) at least one thiapyrylium dye salt, said co-crystalline complex, upon exposure to radiation within the range of from about 520 to about 700 nm., capable of generating and injecting charge carriers into said charge-transport layer, the particulate, co-crystalline complex of said discontinuous phase having a size of about 0.01 to about 25 microns, said charge generation layer having a maximum radiation absorption at a wavelength at least about 10 nm. different from the wavelength of maximum absorption of said thiapyrylium dye salt solubilized with said alkylidene diarylene group-containing polymer in a homogeneous composition, (b) said charge-transport layer being an organic composition having a dry thickness within the range of from about 5 to about 200 times that of said charge-generation layer and free from said co-crystalline complex and any pyrylium-type dye salt, said charge-transport layer comprising as a p-type charge-transport material an organic photoconductive material having a principal absorption band below about 400 nm. and capable of accepting and transporting injected charge carriers from said charge-generation layer.

12. A photoconductive insulating element as defined in claim 11 wherein said charge-transport material contained in said charge-generation layer and in said charge-transport layer is a p-type organic photoconductive selected from the group consisting of carbazole photoconductive materials, arylamine photoconductive materials, and polyarylalkane photoconductive materials.

13. A photoconductive insulating element as defined in claim 11 wherein said charge-transport material contained in said charge-transport layer is a p-type arylamine organic photoconductor.

14. A photoconductive insulating element as defined in claim 11 wherein said charge-transport material contained in said charge-transport layer is a p-type polyarylalkane photoconductor having the formula

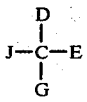

wherein

J and E, which may be the same of different, represent a hydrogen atom, an alkyl group, or an aryl group; and D and G, which may be the same or different represent substituted aryl groups having as a substituent thereof a group represented by the formula

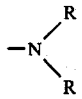

wherein R represents an unsubstituted aryl group or an alkyl substituted aryl group.

15. A photoconductive insulating element as defined in claim 11 wherein said charge-transport material contained in said charge-transport layer is tritolylamine.

16. A photoconductive insulating element having at least two layers comprising a charge-generation layer contiguous to a charge-transport layer, (a) said charge-generation layer having a dry thickness within the range of from about 0.5 to about 5.0 microns and comprising a p-type organic photoconductive charge-transport material in solid solution with a continuous electrically insulating polymer phase and dispersed in said continuous phase a discontinuous phase comprising a finely-divided particulate co-crystalline complex of (i) at least one polymer having an alkylidene diarylene group in a recurring unit and (ii) at least one thiapyrylium dye salt, said co-crystalline complex, upon exposure to radiation within the range of from about 520 to about 700 nm., capable of generating and injecting charge carriers into said charge-transport layer, the particulate, co-crystalline complex of said discontinuous phase having a size of about 0.01 to about 25 microns, said charge generation layer having a maximum radiation absorption at a wavelength at least about 10 nm. different from the wavelength of maximum absorption of said thiapyrylium dye salt solubilized with said alkylidene diarylene group-containing polymer in a homogeneous composition, (b) said charge-transport layer being an electrically insulating organic composition having a dry thickness within the range of from about 10 to about 40 times that of said charge-generation layer, said charge-transport layer being free from said co-crystalline complex and any pyrylium-type dye salt and comprising as a p-type charge-transport material an organic photoconductive material having a principal absorption band below about 400 nm. and capable of accepting and transporting injected charge carriers from said charge-generation layer.

17. A photoconductive insulating element as defined in claim 16 wherein said charge-transport material contained in said charge-generation layer and in said charge-transport layer is a p-type organic photoconductive selected from the group consisting of carbazole photoconductive materials, arylamine photoconductive materials, and polyarylalkane photoconductive materials.

18. A photoconductive insulating element as defined in claim 16 wherein said charge-transport material contained in said charge-transport layer is a p-type arylamine organic photoconductor.

19. A photoconductive insulating element as defined in claim 16 wherein said charge-transport material contained in said charge-transport layer is a p-type polyarylalkane photoconductor having the formula

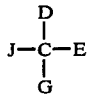

wherein

J and E, which may be the same or different, represent a hydrogen atom, an alkyl group, or an aryl group; and D and G, which may be the same or different represent substituted aryl groups having as a substituent thereof a group represented by the formula

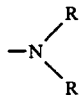

wherein R represents an unsubstituted aryl group or an alkyl substituted aryl group.

20. A photoconductive insulating element as defined in claim 16 wherein said charge-transport material contained in said charge-transport layer is tritolylamine.

21. A photoconductive insulating element having at least two layers comprising a charge-generation layer contiguous to a charge-transport layer, (a) said charge-generation layer having a dry thickness less than about 15.0 microns and comprising a p-type organic photoconductive charge-transport material having a principal absorption band below about 475 nm. in solid solution with a continuous electrically insulating polymer phase and dispersed in said continuous phase a discontinuous phase comprising a finely-divided particulate co-crystalline complex of (i) at least one polymer having an alkylidene diarylene group in a recurring unit and (ii) at least one thiapyrylium dye salt, said co-crystalline complex, upon exposure to activating radiation within the range of from about 520 nm. to about 700 nm., capable of generating and injecting charge carriers into said charge-transport layer, the particulate, co-crystalline complex of said discontinuous phase having a size of about 0.01 to about 25 microns, said charge generation layer having a maximum radiation absorption at a wavelength at least about 10 nm. different from the wavelength of maximum absorption of said thiapyrylium dye salt solubilized with said alkylidene diarylene group-containing polymer in a homogeneous composition, (b) said charge-transport layer being an electrically insulating organic composition having a dry thickness within the range of from about 10 to about 40 times that of said charge-generation layer, said charge-transport layer being free from said co-crystalline complex and any pyrylium-type dye salt, and comprising an electrically insulating polymeric binder and, in solid solution with said binder, a p-type organic photoconductive charge-transport material having a principal absorption band below about 475 nm. and capable of accepting and transporting injected charge carriers from said charge-generation layer.

22. A photoconductive insulating element as defined in claim 21 wherein said p-type organic photoconductive material contained in said charge-generation layer and in said charge-transport layer is an arylamine organic photoconductor.

23. A photoconductive insulating element as defined in claim 21 wherein said electrically insulating polymer phase of said charge-generation layer and the electrically insulating polymeric binder of said charge-transport layer comprise the same polymeric materials.

24. A photoconductive insulating element comprising (a) a conductive support, (b) a polymeric subbing layer overcoating said support, (c) a charge-generation layer overcoating said subbing layer, and (d) a charge-transport layer overcoating said generation layer, (i) said charge-generation layer comprising a continuous, electrically insulating polymer phase and dispersed therein a discontinuous phase comprising a finely-divided particulate co-crystalline complex of (1) at least one polymer having an alkylidene diarylene group in a recurring unit and (2) at least one pyrylium-type dye salt, said co-crystalline complex, upon exposure to activating radiation for said complex, capable of generating and injecting charge carriers into said charge-transport layer, the particulate, co-crystalline complex of said discontinuous phase having a size of about 0.01 to about 25 microns, said charge generation layer having a maximum radiation adsorption at a wavelength at least about 10 nm. different from the wavelength of maximum absorption of said pyrylium-type dye salt solubilized with said alkylidene diarylene group-containing polymer in a homogeneous composition, (ii) said charge-transport layer being an organic composition in electrical contact with said charge-generation layer, said charge-transport layer free from said co-crystalline complex and said pyrylium-type dye salt, said charge-transport layer comprising as a charge-transport material an organic photoconductive material capable of accepting and transporting injected charge carriers from said charge-generation layer.

25. A photoconductive insulating element as defined in claim 24 wherein said subbing layer has a dry thickness in the range of from about 0.1 to about 5 microns and comprises a film-forming polymer.

26. A photoconductive insulating element as defined in claim 24 wherein said subbing layer comprises an electrical barrier layer.

27. A photoconductive insulating element as defined in claim 24 wherein said subbing layer has a dry thickness in the range of from about 0.1 to about 5 microns and comprises a film-forming polymer comprising a polymerized blend of monomers or prepolymers containing at least 60 percent by weight of vinylidene chloride.

28. A photoconductive insulating element as defined in claim 24 wherein said subbing layer comprises a hydrophobic, film-forming polymer and has a dry thickness in the range of from about 0.1 to about 5 microns, said polymer being free of any acid-containing groups and comprising a polymerized blend of monomers or prepolymers, each possessing one or more polymerizable ethylenically unsaturated groups.

29. A photoconductive insulating element as defined in claim 25 wherein said polymer is a polyester.

30. A photoconductive insulating element comprising
(a) a conductive support,
(b) a polymeric subbing layer overcoating said support,
(c) a charge-transport layer overcoating said subbing layer, and
(d) a charge-generation layer overcoating said transport layer,
(i) said charge-generation layer comprising a continuous, electrically insulating polymer phase and dispersed therein a discontinuous phase comprising a finely-divided, particulate co-crystalline complex of (1) at least one polymer having an alkylidene diarylene group in a recurring unit and (2) at least one pyrylium-type dye salt, said co-crystalline complex, upon exposure to activating radiation for said complex, capable of generating and injecting charge carriers into said charge-transport layer, the particulate, co-crystalline complex of said discontinuous phase having a size of about 0.01 to about 25 microns, said charge generation layer having a maximum radiation absorption at a wavelength at least about 10 nm. different from the wavelength of maximum absorption of said pyrylium-type dye salt solubilized with said alkylidene diarylene group-containing polymer in a homogeneous composition,
(ii) said charge-transport layer being an organic composition in electrical contact with said charge-generation layer, said charge-transport layer being free from said co-crystalline complex and said pyrylium-type dye salt, said charge-transport layer comprising as a charge-transport material an organic photoconductive material capable of accepting and transporting injected charge carriers from said charge-generation layer.

31. A photoconductive insulating element as defined in claim 30 wherein said subbing layer has a dry thickness in the range of from about 0.1 to about 5 microns and comprises a film-forming polymer.

32. A photoconductive insulating element as defined in claim 30 wherein said subbing layer comprises an electrical barrier layer.

33. A photoconductive insulating element as defined in claim 30 wherein said subbing layer has a dry thickness in the range of from about 0.1 to about 5 microns and comprises a film-forming polymer comprising a polymerized blend of monomers or prepolymers containing at least 60 percent by weight of vinylidene chloride.

34. A photoconductive insulating element as defined in claim 30 wherein said subbing layer comprises a hydrophobic, film-forming polymer and has a dry thickness in the range of from about 0.1 to about 5 microns, said polymer being free of any acid-containing groups and comprising a polymerized blend of monomers or prepolymers, each possessing one or more polymerizable ethylenically unsaturated groups.

35. A photoconductive insulating element as defined in claim 31 wherein said polymer is a polyester.

36. A photoconductive insulating element comprising
(a) a conductive support,
(b) a charge-generation layer overcoating said support, and
(c) a charge-transport layer overcoating said generation layer,
(i) said charge-generation layer comprising a continuous, electrically insulating polymer phase and dispersed therein a discontinuous phase comprising a finely-divided particulate co-crystalline complex of (1) at least one polymer having an alkylidene diarylene group in a recurring unit and (2) at least one pyrylium-type dye salt, said co-crystalline complex, upon exposure to activating radiation for said complex, capable of generating and injecting charge carriers into said charge-transport layer, the particulate, co-crystalline complex of said discontinuous phase having a size of about 0.01 to about 25 microns, said charge generation layer having a maximum radiation absorption at a wavelength at least about 10 nm. different from the wavelength of maximum absorption of said pyrylium-type dye salt solubilized with said alkylidene diarylene group-containing polymer in a homogeneous composition,
(ii) said charge-transport layer being an organic composition in electrical contact with said charge-generation layer, said charge-transport layer free from said co-crystalline complex and said pyrylium-type dye salt, said charge-transport layer comprising as a charge-transport material an organic photoconductive material capable of accepting and transporting injected charge carriers from said charge-generation layer.

37. A photoconductive insulating element comprising
(a) a conductive support,
(b) a charge-generation layer overcoating said support, and
(c) a charge-transport layer overcoating said generation layer,
(i) said charge-generation layer comprising a continuous, electrically insulating polymer phase and dispersed therein a discontinuous phase comprising a finely-divided particulate co-crystalline complex of (1) at least one polymer having an alkylidene diarylene group in a recurring unit and (2) at least one pyrylium-type dye salt, said co-crystalline complex, upon exposure to activating radiation for said complex, capable of generating and injecting charge carriers into said charge-transport layer, said charge-generation layer having a maximum radiation absorption at a wavelength at least about 10 nm. different from the wavelength of maximum absorption of said pyrylium-type dye salt solubilized with said alkylidene diarylene group-containing polymer in a homogeneous composition,
(ii) said charge-transport layer being an organic composition in electrical contact with said charge-generation layer, said charge-transport layer free from said co-crystalline complex and said pyrylium-type dye salt, said charge-transport layer comprising as a charge-transport material an organic photoconductive material capable of accepting and transporting injected charge carriers from said charge-generation layer.

38. In an electrophotographic process wherein an electrostatic charge pattern is formed by a photoconductive insulating element, the improvement wherein said photoconductive insulating element used to form said charge pattern is a photoconductive insulating element as defined in claim 37.

39. A photoconductive insulating element comprising
(a) a conductive support,
(b) a charge-transport layer overcoating said support, and
(c) a charge-generation layer overcoating said transport layer,
(i) said charge-generation layer comprising a continuous, electrically insulating polymer phase and dispersed therein a discontinuous phase comprising a finely-divided, particulate co-crystalline complex of (1) at least one polymer having an alkylidene diarylene group in a recurring unit and (2) at least one pyrylium-type dye salt, said co-crystalline complex, upon exposure to activating radiation for said complex, capable of generating and injecting charge carriers into said charge-transport layer, the particulate, co-crystalline complex of said discontinuous phase having a size of about 0.01 to about 25 microns, said charge generation layer having a maximum radiation absorption at a wavelength at least about 10 nm. different from the wavelength of maximum absorption of said pyrylium-type dye salt solubilized with said alkylidene diarylene group-containing polymer in a homogeneous composition,
(ii) said charge-transport layer being an organic composition in electrical contact with said charge-generation layer, said charge-transport layer being free from said co-crystalline complex and said pyrylium-type dye salt, said charge-transport layer comprising as a charge-transport material an organic photoconductive material capable of accepting and transporting injected charge carriers from said charge-generation layer.

40. A photoconductive insulating element comprising
(a) a conductive support,
(b) a charge-transport layer overcoating said support, and
(c) a charge-generation layer overcoating said transport layer,
(i) said charge-generation layer comprising a continuous, electrically insulating polymer phase and dispersed therein a discontinuous phase comprising a finely-divided, particulate co-crystalline complex of (1) at least one polymer having an alkylidene diarylene group in a recurring unit and (2) at least one pyrylium-type dye salt, said co-crystalline complex, upon exposure to activating radiation for said complex, capable of generating and injecting charge carriers into said charge-transport layer, said charge-generation layer having a maximum radiation absorption at a wavelength at least about 10 nm. different from the wavelength of maximum absorption of said pyrylium-type dye salt solubilized with said alkylidene diarylene group-containing polymer in a homogeneous composition,
(ii) said charge-transport layer being an organic composition in electrical contact with said charge-generation layer, said charge-transport layer being free from said co-crystalline complex and said pyrylium-type dye salt, said charge-transport layer comprising as a charge-transport material an organic photoconductive material capable of accepting and transporting injected charge carriers from said charge-generation layer.

41. In an electrophotographic process wherein an electrostatic charge pattern is formed by a photoconductive insulating element, the improvement wherein said photoconductive insulating element used to form said charge pattern is a photoconductive insulating element as defined in claim 40.

42. A photoconductive insulating element having at least two layers comprising a charge-generation layer in electrical contact with a charge-transport layer,
(a) said charge-generation layer comprising a continuous, electrically insulating polymer phase and dispersed in said continuous phase a discontinuous phase comprising a finely-divided, particulate co-crystalline complex of (i) at least one polymer having an alkylidene diarylene group in a recurring unit and (ii) at least one pyrylium-type dye salt, said co-crystalline complex, upon exposure to activating radiation for said complex, capable of generating and injecting charge carriers into said charge-transport layer, said charge-generation layer having a maximum radiation absorption at a wavelength at least about 10 nm. different from the wavelength of maximum absorption of said pyrylium-type dye salt solubilized with said alkylidene diarylene group-containing polymer in a homogeneous composition,
(b) said charge-transport layer being an organic composition free from said co-crystalline complex and said pyrylium-type dye salt, and comprising as a charge-transport material an organic photoconductive material capable of accepting and transporting injected charge carriers from said charge-generation layer.

43. A photoconductive insulating element having at least two layers comprising a charge-generation layer in electrical contact with a charge-transport layer,
(a) said charge-generation layer having a dry thickness less than about 15 microns and comprising a continuous electrically insulating polymer phase and dispersed in said continuous phase a discontinuous phase comprising a finely-divided particulate co-crystalline complex of (i) at least one polymer having an alkylidene diarylene group in a recurring unit and (ii) at least one thiapyrylium dye salt, said co-crystalline complex, upon exposure to radiation within the range of from about 520 to about 700 nm., capable of generating and injecting charge carriers into said charge-transport layer, said charge-generation layer having a maximum radiation absorption at a wavelength at least about 10 nm. different from the wavelength of maximum absorption of said thiapyrylium dye salt solubilized with said alkylidene diarylene group-containing polymer in a homogeneous composition,
(b) said charge-transport layer being an organic composition free from said co-crystalline complex and any pyrylium-type dye salt and comprising as a charge-transport material an organic photoconductive material having a principal absorption band below about 475 nm. and capable of accepting and transporting injected charge carriers from said charge-generation layer.

44. A photoconductive insulating element having at least two layers comprising a charge-generation layer contiguous to a charge-transport layer, (a) said charge-generation layer having a dry thickness within the range of from about 0.5 to about 5.0 microns and comprising a continuous electrically insulating polymer phase and dispersed in said continuous phase a discontinuous phase comprising a finely-divided particulate co-crystalline complex of (i) at least one polymer having an alkylidene diarylene group in a recurring unit and (ii) at least one thiapyrylium dye salt, said co-crystalline complex, upon exposure to radiation within the range of from about 520 to about 700 nm., capable of generating and injecting charge carriers into said charge-transport layer, said charge-generation layer having a maximum radiation absorption at a wavelength at least about 10 nm. different from the wavelength of maximum absorption of said thiapyrylium dye salt solubilized with said alkylidene diarylene group-containing polymer in a homogeneous composition, (b) said charge-transport layer being an electrically insulating organic composition having a dry thickness within the range of from about 10 to about 40 times that of said charge-generation layer, said charge-transport layer being free from said co-crystalline complex and any pyrylium-type dye salt and comprising as a p-type charge-transport material an organic arylamine or polyarylalkane photoconductive material capable of accepting and transporting injected charge carriers from said charge-generation layer.

45. A photoconductive insulating element having at least two layers comprising a charge-generation layer in electrical contact with a charge-transport layer, (a) said charge-generation layer comprising a continuous, electrically insulating polymer phase and dispersed in said continuous phase a discontinuous phase comprising a finely-divided, particulate co-crystalline complex of (i) at least one polymer having an alkylidene diarylene group in a recurring unit and (ii) at least one pyrylium-type dye salt, said co-crystalline complex, upon exposure to activating radiation for said complex, capable of generating and injecting charge carriers into said charge-transport layer, said charge-generation layer having a maximum radiation absorption at a wavelength at least about 10 nm. different from the wavelength of maximum absorption of said pyrylium-type dye salt solubilized with said alkylidene diarylene group-containing polymer in a homogeneous composition, (b) said charge-transport layer being an organic composition free from said co-crystalline complex and said pyrylium-type dye salt, and containing as a charge-transport material an organic photoconductive material comprising a metallo-organic material capable of accepting and transporting injected charge carriers from said charge-generation layer.

46. A photoconductive insulating element as defined in claim 45 wherein said charge-generation layer has a dry thickness within the range of from about 0.5 to about 5.0 microns and said pyrylium-type dye salt employed in said co-crystalline complex comprises a thiapyrylium dye salt, and wherein said charge-transport layer has a dry thickness within the range of from about 10 to about 40 times that of said charge-generation layer.

47. A photoconductive insulating element having at least two layers comprising a charge-generation layer in electrical contact with a charge-transport layer, (a) said charge-generation layer comprising a continuous, electrically insulating polycarbonate polymer phase and dispersed in said continuous phase a discontinuous phase comprising a finely-divided, particulate co-crystalline complex of (i) at least one polycarbonate polymer having an alkylidene diarylene group in a recurring unit and (ii) at least one pyrylium-type dye salt, said co-crystalline complex, upon exposure to activating radiation for said complex, capable of generating and injecting charge carriers into said charge-transport layer, said charge-generation layer having a maximum radiation absorption at a wavelength at least about 10 nm. different from the wavelength of maximum absorption of said pyrylium-type dye salt solubilized with said alkylidene diarylene group-containing polymer in a homogeneous composition, (b) said charge-transport layer being an organic composition free from said co-crystalline complex and said pyrylium-type dye salt, and comprising (i) an electrically insulating polycarbonate polymer and (ii) as a charge-transport material an organic photoconductive material capable of accepting and transporting injected charge carriers from said charge-generation layer.

* * * * *